US011096449B2

(12) United States Patent
Krout et al.

(10) Patent No.: US 11,096,449 B2
(45) Date of Patent: Aug. 24, 2021

(54) CLIP WITH SIDE OPENING

(71) Applicant: Iconsky LLC, Bellevue, WA (US)

(72) Inventors: Jasmin Zya Krout, Bellevue, WA (US); Marlaina Jolie Elliott, Langley (CA)

(73) Assignee: Iconsky LLC, Bellevue, WA (US)

( * ) Notice: Subject to any disclaimer, the term of this patent is extended or adjusted under 35 U.S.C. 154(b) by 0 days.

(21) Appl. No.: 16/713,715

(22) Filed: Dec. 13, 2019

(65) Prior Publication Data

US 2020/0187596 A1 Jun. 18, 2020

Related U.S. Application Data

(60) Provisional application No. 62/779,732, filed on Dec. 14, 2018.

(51) Int. Cl.
*A43C 7/00* (2006.01)

(52) U.S. Cl.
CPC ..... *A43C 7/00* (2013.01)

(58) Field of Classification Search
CPC ..... Y10T 24/3984; F16G 11/101; A43C 7/00
See application file for complete search history.

(56) References Cited

U.S. PATENT DOCUMENTS 3,271,510 A * 9/1966 Decker ..... F16G 11/00 174/146
3,604,069 A * 9/1971 Jensen ..... A44B 99/00 24/332
4,453,292 A 6/1984 Bakker
4,506,417 A * 3/1985 Hara ..... F16G 11/101 24/115 G
4,694,544 A 9/1987 Chapman
4,763,388 A * 8/1988 Kemble ..... B65D 33/1616 24/30.5 R
4,803,759 A * 2/1989 Kemble ..... F16G 11/101 24/30.5 R
D399,045 S 10/1998 Liston
D417,388 S 12/1999 Kawahara
6,026,548 A 2/2000 Jackson
D430,484 S 9/2000 Ikeda
D481,301 S 10/2003 Nezu
7,228,655 B2 6/2007 Slatter
D548,578 S 8/2007 Wu
D549,087 S 8/2007 Pontaoe
D571,194 S 6/2008 Mei
D584,942 S 1/2009 Yoshie
D587,105 S 2/2009 Chang
D618,984 S 7/2010 Yang
D668,137 S 10/2012 Kao
(Continued)

*Primary Examiner* — Robert Sandy
(74) *Attorney, Agent, or Firm* — Seed IP Law Group LLP

(57) ABSTRACT

A clip includes an inner housing slidably received in an outer housing with a spring housed in the outer housing between a base of the outer housing and the inner housing. Each of the inner and outer housings include a side opening and a main cavity. When a user manipulates the inner housing, the side openings are aligned with one another, such that a user can insert an object through the respective side openings to be secured within the main cavity of the clip. The clip may further include a decorative member coupled to the outer housing, wherein the decorative member includes a design or a safety feature formed on an outerwardly directed surface thereof.

19 Claims, 18 Drawing Sheets

(56) References Cited

U.S. PATENT DOCUMENTS

| | | | |
|---|---|---|---|
| D676,734 | S | 2/2013 | Moreau et al. |
| D684,846 | S | 6/2013 | DePhillips |
| D692,293 | S | 10/2013 | Toscani et al. |
| D736,603 | S | 8/2015 | Petzl |
| D738,707 | S | 9/2015 | Tung |
| D789,767 | S | 6/2017 | Lu |
| D836,561 | S | 12/2018 | Hung |
| D878,911 | S | 3/2020 | Cox |
| 2004/0074055 | A1 | 4/2004 | Watabe |

* cited by examiner

CLIP WITH SIDE OPENING

BACKGROUND

Technical Field

The present disclosure is directed to a clip, and more particularly, to a spring lock clip having a side opening.

Description of the Related Art

Spring cord locks are known for use with back packs, jackets, and other items. Typical spring cord locks include a cavity and a button that, when depressed, compresses a spring and allows access to the cavity. A cord or string is threaded through the cavity and the force on the button is released, which causes the spring to push the button to its original position, thus trapping the cord in the cavity. As such, a user can follow a similar procedure to manipulate the spring cord lock and adjust the length of a cord, such as on the hem of a jacket or a drawstring on a backpack, for example.

In addition, many people suffer from dexterity challenges that make tying shoelaces into a traditional shoelace knot very difficult, if not impossible. As such, when shoelaces become untied during normal activity, such users experience difficulty retying their shoelaces.

One proposed solution to this issue has been to use a typical spring cord lock in association with the shoelaces to secure the shoelaces in position, either before or after tying them. However, such solutions require threading the shoelace through one or more cavities of the spring cord lock and as such, continue to present challenges for users with dexterity challenges. Some systems have utilized a threading device to assist in threading the shoelace through the spring cord lock, but this approach is time consuming and inefficient, because the success of the system depends on the user constantly having a threading device available when it is time to attach the cord lock, or whenever the cord lock is to be removed and adjusted. Moreover, use of the threading device itself can present dexterity challenges. Finally, using a traditional spring cord lock with shoelaces does not create an appealing design aesthetic, because the spring cord locks are large and bulky, which may not only be embarrassing for some users because it may indicate that the user has difficulty tying shoelaces, but also because it detracts from the design appeal of a user's shoes.

BRIEF SUMMARY

The embodiments in the present disclosure are directed to providing a clip that is easy to manipulate and attach to shoelaces via a side opening on the clip. While such clips are not limited to use by those with dexterity challenges that lead to difficulty tying shoelaces, the clips of the present disclosure will be particularly useful for such users. Moreover, embodiments of the present disclosure include decorative attachments for the clips that are aesthetically pleasing and further increase the appeal of the clips.

In one or more embodiments, a clip is provided that includes an outer housing generally in the shape of a cylinder with at least one flat outer surface and a circular bore extending from a top or upper portion of the clip to a base of the clip. An inner housing, which may also be a cylinder, is slidably received in the bore of the outer housing and includes a plate at an upper portion thereof. A spring is housed within the outer housing and positioned between the base of the outer housing, which is closed, and a base of the inner housing. As such, the inner housing is manipulatable, as is the spring, between a first position and a second position by applying a compressive force to the plate to compress the spring.

The outer housing further includes an opening in a surface of the clip that is opposite to the flat surface (i.e. a second surface), wherein the opening extends through sidewalls of the outer housing to join the bore. A cavity extends through the clip between the flat surface and the second surface to join the opening. In other words, the clip includes a side opening opposite the flat surface that allows access to the main cavity or channel of the clip. Similarly, the inner housing includes an opening in a sidewall of the inner housing connected to a cavity extending through the inner housing.

When the clip, and more particularly the inner housing, is in the first position, there is no compressive force exerted on the plate and the spring, and the inner housing extends out of the outer housing. As such, sidewalls of the inner housing block the opening and the cavity of the outer housing. In other words, in the first position, an object cannot be inserted through the side opening to be secured in the cavity. In this configuration or position, the spring is exerting a generally upwards force against the inner housing and protrusions or tabs extending from the inner housing contact an outer edge of the cavity of the outer housing to prevent the inner housing from becoming disengaged with the outer housing. As such, a combination of the force exerted by the spring and the protrusions hold the inner housing in the first position. When a user asserts a compressive force on the plate, the inner housing moves downward by compressing the spring. As the inner housing moves to the second position, the opening and the cavity of the inner housing align with the opening and cavity of the outer housing, such that an object can be inserted through the side opening into the main cavity. When the user releases the force, the object becomes secured in the cavity by virtue of the spring forcing the inner housing back to the first position.

As such, in operation, the user presses down on the plate, thus moving the inner housing from the first position to the second position to allow access to the cavity via the side opening. Then, a user inserts shoelaces through the side opening on one side of the shoelace knot and adjusts the clip so that the clip is securely positioned proximate the knot. The user releases the pressure on the plate, which causes the spring to return the inner housing from the second position to the first position, which secures the shoelaces in the cavity. Preferably, two clips will be used, one for each side of the shoelace knot, although the present disclosure includes embodiments where a singular clip can be used with a larger cavity and opening to receive the shoelace knot, thus enabling use of only one clip.

Embodiments of the present disclosure further include a decorative attachment with at least one flat and planar surface to be permanently or removeably coupled to the flat surface of the outer housing. The decorative attachment includes an externally facing decorative surface that may be adorned, imprinted, or otherwise modified with artwork or safety elements, such as reflective materials, glow materials, or glow in the dark materials. In addition, embodiments of the present disclosure include protrusions on the inner housing and the outer housing which extend into the internal bore of the spring to hold it in place between the outer housing and inner housing. Moreover, embodiments of the present disclosure include the inner housing having a separate set of opposing protrusions that align with a pair of opposing recesses in the cavity of the outer housing, wherein when the clip is in the first position, the protrusions contact an outer boundary of the cavity of the outer housing to prevent the inner housing from becoming disengaged with the outer housing and wherein when the clip is in the second position, the protrusions are received in corresponding recesses to allow the clip to fully open.

Finally, embodiments of the present disclosure include the inner housing having a pair of opposing blades or ridges extending along at a least a portion of a height of the inner housing and a corresponding pair of channels in the outer housing for receiving the blades, such that the inner housing cannot rotate relative to the outer housing.

BRIEF DESCRIPTION OF THE SEVERAL VIEWS OF THE DRAWINGS

For a better understanding of the embodiments, reference will now be made by way of example only to the accompanying drawings. In the drawings, identical reference numbers identify similar elements or acts. The sizes and relative positions of elements in the drawings are not necessarily drawn to scale. For example, some of these elements may be enlarged and positioned to improve drawing legibility. Further, the particular shapes of the elements as drawn are not necessarily intended to convey any information regarding the actual shape of the particular elements, and may have been selected solely for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures have not been shown or described in detail to avoid unnecessarily obscuring descriptions of the embodiments.

The present disclosure is directed to a clip that is easy to manipulate and attach to tied shoelaces to keep them tied while maintaining an attractive design aesthetic.

Figure 1:
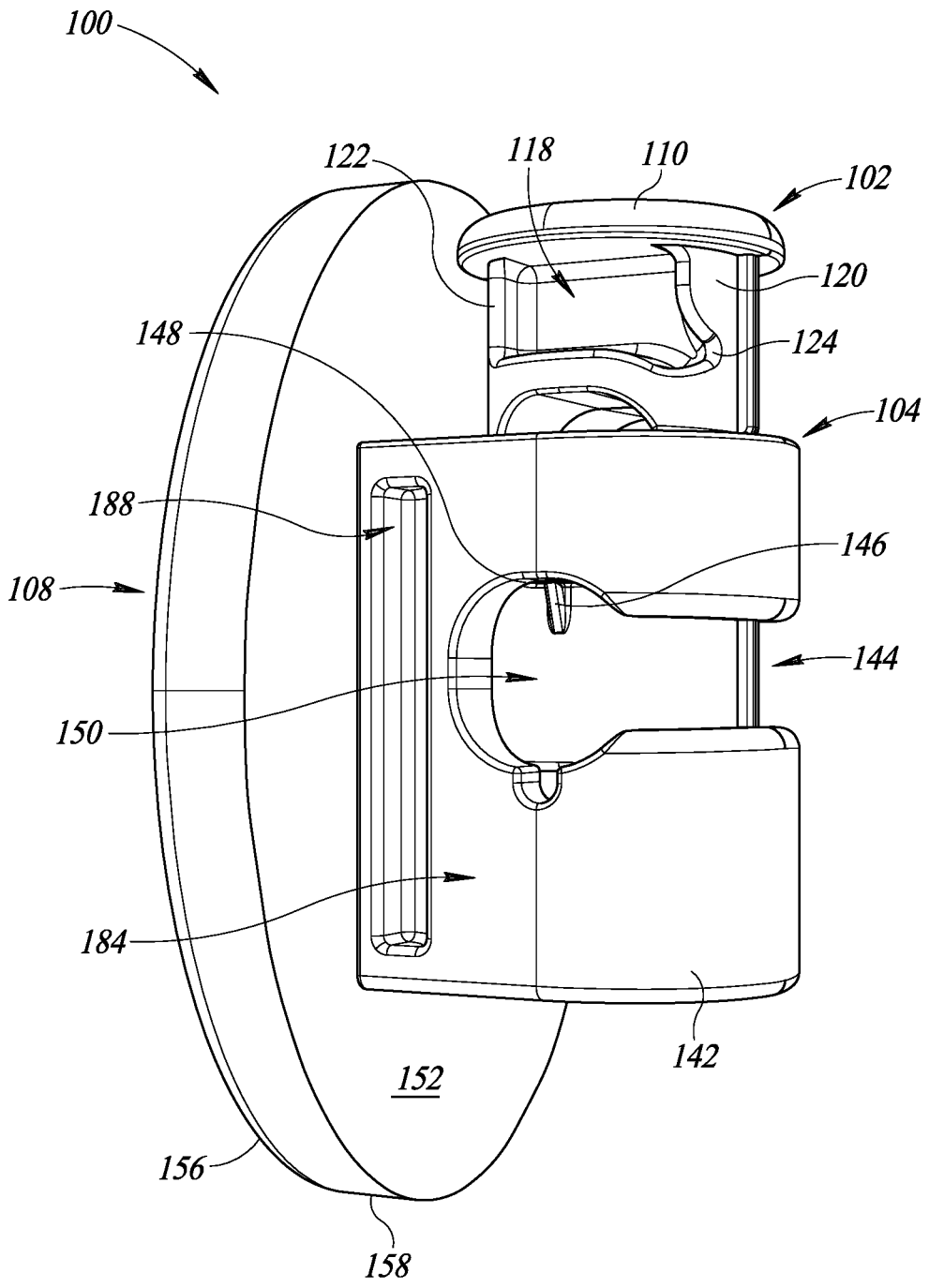
FIG. 1 is a perspective view of an embodiment of a clip according to the present disclosure with a side opening and illustrated in a first position.
Figure 2:
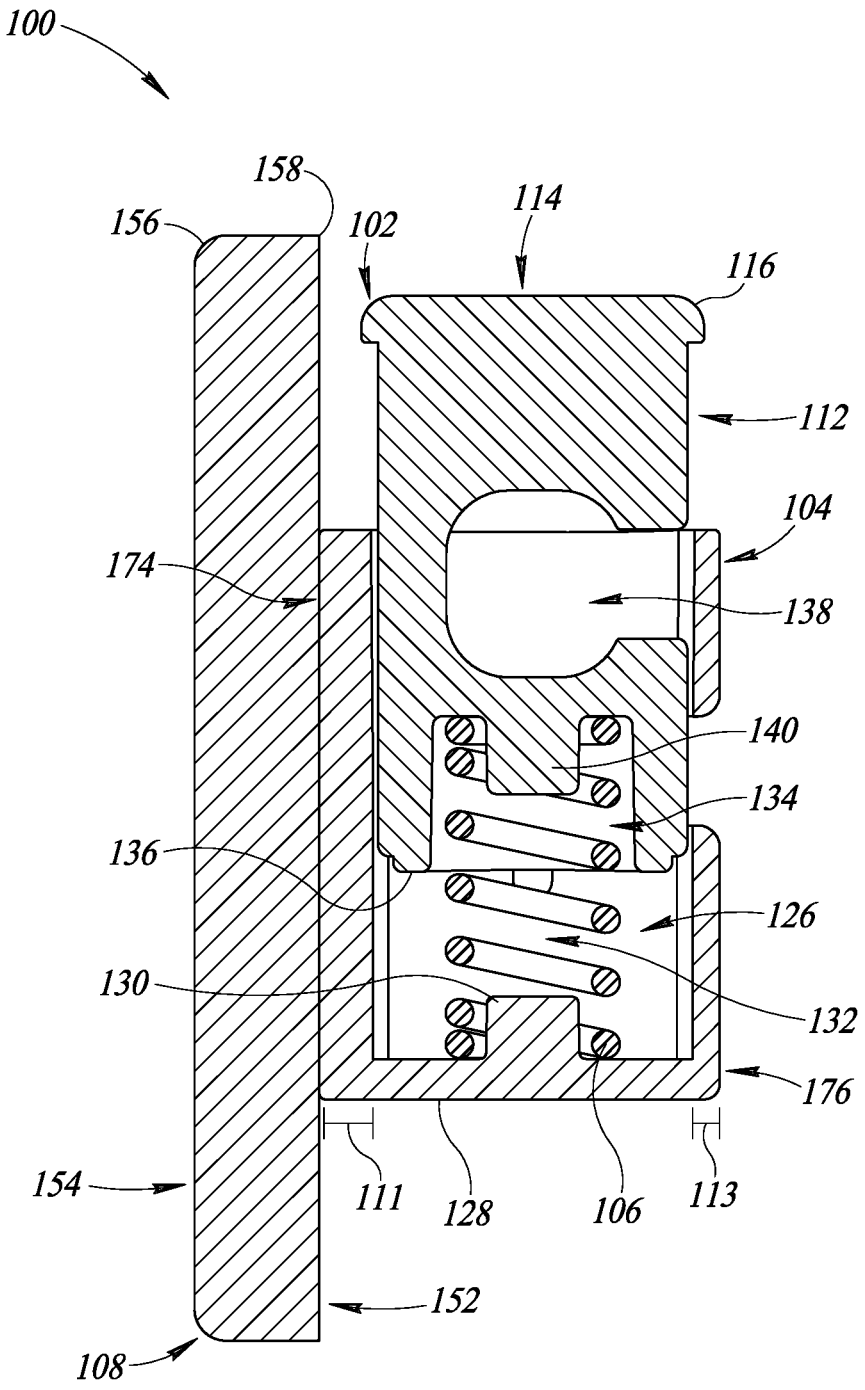
FIG. 2 is a cross-sectional view of the clip of FIG. 1 showing a spring between the inner and outer housings of the clip.

With reference to FIGS. 1-2, illustrated therein is an embodiment of a device 100, such as a clip, having an inner housing 102 received in an outer housing 104. The clip includes a first surface 174 that is flat and opposite a second surface 176 that is curved. The first surface 174 is coupled to a decorative member 108 that is larger than the first surface. The decorative member 108 can carry any number of images, letters, numbers, or other designs that the user can select to decorate their shoelaces or some other object.

The clip includes a side opening 144 in the second surface 176. When the first or inner housing 102 is in a depressed position, a C-shaped opening or cavity 138 can easily receive a shoelace or some other thin material. When released from the depressed position, the first housing slides upwards and locks the shoelace or other material in place, both holding the shoelace in a particular position and providing or displaying the decorative member presenting a design. Specific details of these features are explained in more detail below.

A spring 106 is housed within the outer housing 104, as described herein, and is positioned between the inner housing 102 and the outer housing 104. In certain embodiments, a decorative member 108 is coupled to the outer housing 104. The inner housing 102 and the outer housing 104 will be described in additional detail with reference to FIGS. 3 and 4, respectively. In this embodiment, the inner housing 102 and the outer housing 104 generally have the shape of a cylinder, although the outer housing 104 preferably includes at least one flat surface, as described herein. As such, the inner housing 102 and the outer housing 104 may also be referred to, in certain embodiments, as an inner and outer cylinder or as an inner and outer body, respectively. Alternatively, the inner housing 102 and the outer housing 104 may be referred to, in general, as housings or bodies.

Moreover, it is to be appreciated that although the inner housing 102 and the outer housing 104 are generally illustrated as cylinders, that the inner housing 102 and the outer housing 104 can also be other geometric shapes with different cross sections. For example, the inner housing 102 and the outer housing 104 may also have an ovular shape, a rectangular shape, a square shape, or others. Preferably, the inner housing 102 has a size and shape to be received in the outer housing 104, or in other words, the inner housing 102 has a substantially similar, albeit slightly smaller shape as compared to the outer housing 104 such that the inner housing 102 is slidably received in the outer housing 104.

In FIG. 1, the clip 100, or more particularly, the inner housing 102, is illustrated in a first position, which corresponds to a closed or relaxed position. The inner housing 102 includes a plate or button 110 coupled to the inner housing 102 at a first or upper portion 112 of the inner housing 102. The plate 110 includes a flat and planar outer surface 114 with a rounded edge 116 defining boundaries of the flat and planar outer surface 114. The rounded edge 116 and the flat and planar outer surface 114 provide a gentle tactile response to a user when a user presses their finger or attempts to press their finger against the plate 110 to manipulate the clip 100. In various other embodiments, the rounded edge 116 is rectilinear or chamfered. In some instances, the inner housing is a plug formed of a single plastic component. In other instances, the plug may include a pad on the plate 110 that may be larger than the plate to provide a larger, more gripable surface.

In yet further embodiments, although not specifically illustrated, the plate 110 includes a hole in the outer surface 114, which is preferably centrally disposed with respect to the plate 110. In such embodiments, a piece of rubber, silicone, or other material with a corresponding size and shape to the plate 110 and a corresponding protrusion for the hole is fitted to the plate 110 to improve the tactile response for a user attempting to manipulate the plate 110. The protrusion may be received in the hole with a friction fit, or secured with one or more various adhesives, among other coupling or fastening options. Similarly, although not specifically illustrated, the base 128 of the outer housing 104 can include a hole, which is preferably centrally disposed with respect to the base 128. In such embodiments, a piece of rubber, silicone, or other material with a corresponding size and shape to the base 128 and a corresponding protrusion for the hole is fitted to the base, as described above with reference to the plate 110.

In various other embodiments, the plate 110 and the base 128 do not include a hole and the additional rubber pieces do not include a corresponding protrusion, but rather, the rubber pieces are coupled directly to the plate 110 and the base 128 with adhesive or other fastening methods or otherwise integrated within the plate or base. Further, although it is preferable that both the plate 110 and the base 128 include an additional piece of rubber to improve the tactile response of the clip 100, in certain embodiments, only the plate 110 includes an additional piece of rubber, only the base 128 includes an additional piece of rubber, or neither the plate 110 nor the base 128 include an additional piece of rubber, in which case, the rounded edges of the plate 110 and the base 128 assist with providing a gentle tactile response to the user.

In some embodiments, the additional pieces of rubber, silicone, or other material are set back 0.5 mm or approximately 0.5 mm (i.e. between 0.25 mm and 1 mm) from an outer edge of the base 128 or the plate 110. In other words, there is a space or gap between an outermost edge of each additional piece of silicone and an outermost edge of the base 128 of the plate 110 that is preferably 0.5 mm or approximately 0.5 mm to ensure that the silicone pieces are permanently bonded and that the outermost edge of each silicone piece would not have an exposed edge that could be peeled off from the base 128 or the plate 110. Each additional piece of silicone is preferably 1.5 mm thick or approximately 1.5 mm (i.e. between 1 mm and 2 mm) thick. Moreover, each of the additional pieces of rubber, silicone, or other material preferably have an outermost edge, which is a circumference in an embodiment, that is one of filleted, rounded, chamfered, or square. Of the above, it is preferable that the outermost edge be rounded or filleted so as to provide for a smooth finish to each additional piece of silicone that improves the tactile response to a user, but the same is not required.

The inner housing 102 further includes at least a first recess 118 proximate the plate 110 and extending into sidewalls 120 of the inner housing 102 at the first or upper portion 112, wherein the first recess 118 includes at least one straight edge 122 and at least one curved edge or cavity 124. However, more preferably, the first recess 118 includes at least two straight edges and a plurality of curved edges, although in other embodiments, each of the edges are straight or each of the edges are curved. The first recess 118 provides support for the plate 110 and also facilitates efficiency in manufacturing the clip 100 by injection molding, in certain embodiments. Aspects of this shape are aesthetic and other shapes are envisioned. As such, each of the edges of the first recess 118 are preferably rounded for a smooth appearance. There are added benefits such as preventing a user from injuring their finger when attempting to manipulate the clip 100. In other embodiments, these edges are rectilinear or chamfered.

The outer housing 104 includes a longitudinal axial bore 126, wherein the inner housing 102 is slidably received within the axial bore 126. The spring 106 is positioned in the axial bore 126 between a base 128 of the outer housing 104 and the inner housing 102. A protrusion 130 extends from the base 128 of the outer housing 104 and into the axial bore 126. The spring 106 includes an internal bore 132, wherein the protrusion 130 of the outer housing 104 extends into the internal bore 132 to hold the spring 106 in place relative to the outer housing 104. The inner housing 102 further includes an axial bore 134 extending into the inner housing 102 from a base 136 of the inner housing 102 to a location proximate a cavity 138 of the inner housing 102, as illustrated in FIG. 2. The inner housing 102 also includes a protrusion 140 extending into the axial bore 134 of the inner housing 102 towards the base 136 of the inner housing 102, wherein the protrusion 140 is received in the internal bore 132 of the spring 106 to hold the spring 106 in place relative to the inner housing 102.

The spring 106 preferably comprises steel and includes 5 coils between the outermost, or top and bottom coils. While steel is preferable because of its durability and anti-rust properties, such that the spring 106 will not rust when spring 106 comes into contact with moisture during everyday use over a period of time, the present disclosure includes other materials for the spring 106, including various other metals and their alloys as well as plastic and polymer compositions, for example. The spring 106 has a wire diameter of between 0.1 and 2 millimeters ("mm"), but more preferably, the wire diameter is 0.6 mm or approximately 0.6 mm (i.e. between 0.5 and 0.7 mm). Further, the spring 106 has a height between 8 and 15 mm, but more preferably, the height is 12.75 mm or approximately 12.75 mm (i.e. between 12 and 13.5 mm).

An outer diameter of the spring 106 is between 2 and 10 mm, but more preferably, is 5.4 mm or approximately 5.4 mm (i.e. between 5 and 6 mm). In addition, an inner diameter of the spring 106, or a diameter of the internal bore 132, is between 1 and 8 mm, but more preferably, is 4 mm or approximately 4 mm (i.e. between 3 and 5 mm). When the spring 106 is comprised of steel with the preferable dimensions above, the compression force required to compress the spring 106 is 9.2 pounds per square inch ("psi") or approximately 9.2 psi (i.e. between 9 and 9.5 psi). In other words, the force required to be applied to the plate 110 to manipulate the clip 100 is preferably 9.2 psi. This amount of force generally corresponds to the strength of a 5 year old child and as such, the clip 100 is designed for use by a child without the assistance of an adult.

The outer housing 104 further includes sidewalls 142 and a side opening 144 extending through the sidewalls 142, as further described herein. In the first position illustrated in FIGS. 1 and 2, sidewalls 120 of the inner housing 102 block the side opening 144 such that an object, for example, shoelaces, cannot be inserted through the side opening 144 to be retained within the clip 100. Further, the inner housing 102 includes a pair of opposing protrusions 146 extending from sidewalls 120 of the inner housing 102, wherein in the first position, each of the pair of opposing protrusions 146 contacts, or is located proximate to, an outer edge 148 of a cavity 150 extending through the outer housing 104. As such, the pair of opposing protrusions 146 prevent the inner housing 102 from disengaging with the outer housing 104 by virtue of the spring 106 exerting a generally upward (i.e. relative to the orientation of the clip 100 shown in FIGS. 1 and 2) force against the inner housing 102 in the first position. Moreover, while it is preferable that the inner housing 102 includes a pair of opposing protrusions 146, embodiments of the present disclosure include the inner housing 102 having only one protrusion 146, as well as more than two protrusions 146.

The outer housing 104 includes a first surface 174 opposite a second surface 176, as more clearly illustrated with reference to FIG. 5. A thickness 111 (see FIG. 2) of the sidewalls 142 of the outer housing 104 proximate the first surface 174 is greater than a thickness 113 (see FIG. 2) of the outer housing 104 proximate the second surface 176. For example, in an embodiment, the thickness 111 is 2.2 mm or approximately 2.2 mm (i.e. between 1.7 and 2.7 mm) and the thickness 113 is 1.3 mm or approximately 1.3 mm (i.e. between 1 and 1.6 mm). As such, the axial bore 126 of the outer housing 104 is closer to the second surface 176 of the outer housing 104 than the first surface 174 of the outer housing 104, although in other embodiments, the axial bore 126 is centrally disposed with respect to the outer housing 104, such that thicknesses 111, 113 are the same. In yet further embodiments, the axial bore 126 is disposed closer to the first surface 174 than the second surface 176, in which case the thickness 113 is greater than the thickness 111.

The decorative member 108 includes a first surface 152 opposite a second surface 154, wherein the first surface 152 is coupled to the outer housing 104 and the second surface 154, although not specifically shown, includes artwork or a safety indicator, such as reflective or glow in the dark paint, tape, or dye, which has been painted, imprinted, stamped, impregnated, or otherwise formed on the second surface 154. The decorative member 108 includes a rounded edge 156 extending around a perimeter of the second surface 154 to define boundaries of the second surface 154 and a rectilinear edge 158 extending around a perimeter of the first surface 152 to define boundaries of the first surface 152. Further, it is to be appreciated that in various embodiments, the curved edge 156 is rectilinear or chamfered and the rectilinear edge 158 is curved or chamfered. While the edges 156, 158 are illustrated herein as being different (i.e. one rounded, one rectilinear), it is to be understood that in other embodiments, such edges are the same.

Figure 5:
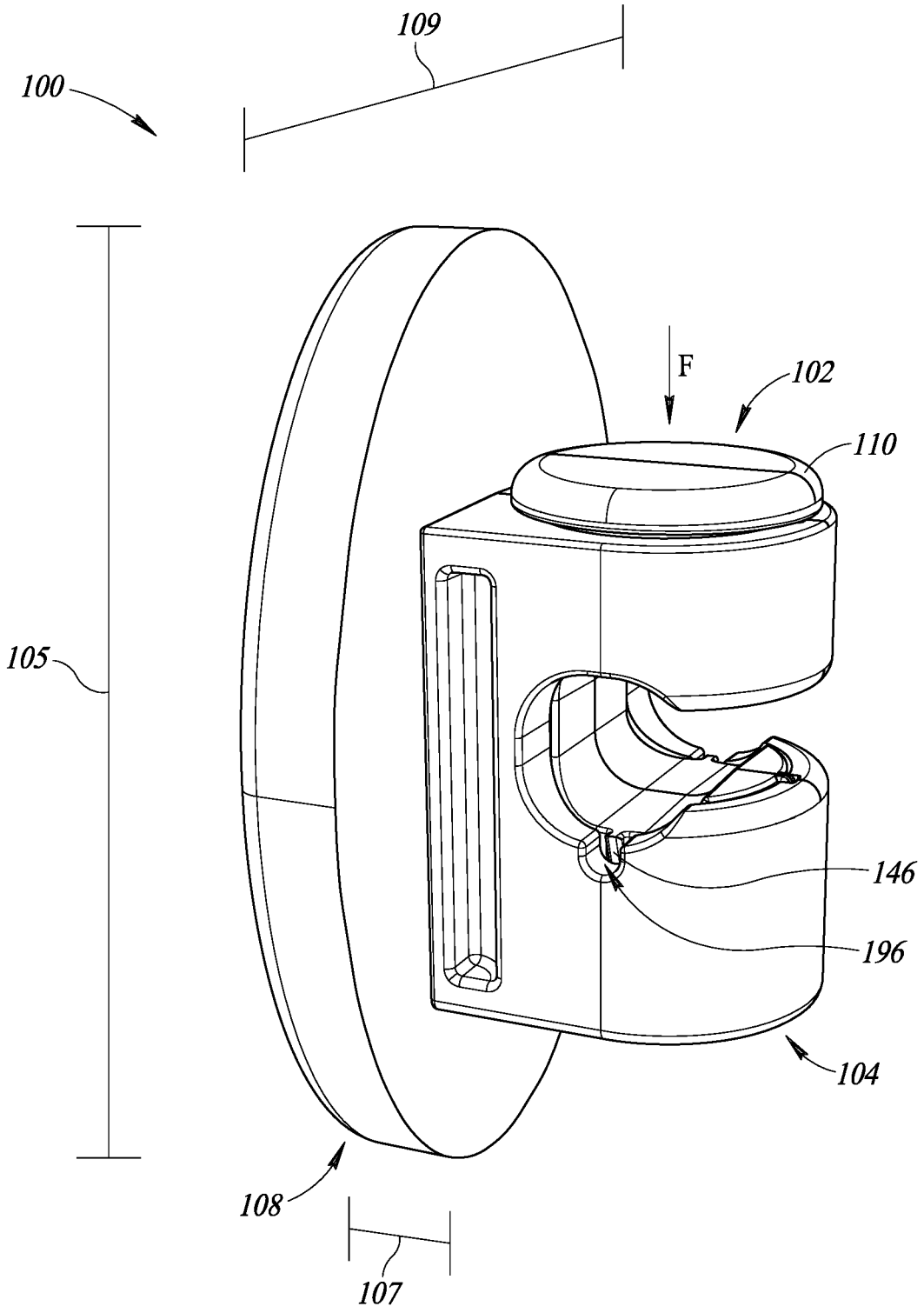
FIG. 5 is a perspective view of the clip of FIG. 1 showing the clip in the second position.

In addition, the decorative member 108 preferably has a generally ovular shape with a size and a shape such that when viewing the clip 100 from the front (i.e. looking at the decorative member 108), the inner housing 102 and the outer housing 104 are not visible in either the first position described above or a second position described herein with reference to FIG. 5. It is to be further appreciated that in some embodiments, the clip 100 does not include the decorative member 108, in which case, the outer housing 104 and the inner housing 102 preferably have a generally ovular, or rectangular shape. In other words, in such embodiments, there is not necessarily two surfaces that are distinctly different (i.e. one flat and one curved surface as in the illustrated embodiment), but rather opposite surfaces of the outer housing 104 and the inner housing 102 are similar. Such an arrangement may be preferable when the clip 100 is used by an adult, for example, whom does not prefer to have the decorative member 108 or a design on their tied shoelaces.

The inner housing 102 and the outer housing 104 are preferably formed of plastic, although embodiments of the present disclosure include the inner housing 102 and the outer housing 104 formed from other materials as well, such as various polymers, silicone, acrylics, plastics, or combinations thereof, and even metal or wood, among others. In embodiments where the inner housing 102 and the outer housing 104 are formed from plastic, formation includes forming by blow molding, compression molding, injection molding, and 3D printing, among others. Moreover, the decorative member 108 preferably comprises polyvinyl chloride, but may be formed from plastic, silicone, acrylic, metal, wood, or other materials.

Figure 3:
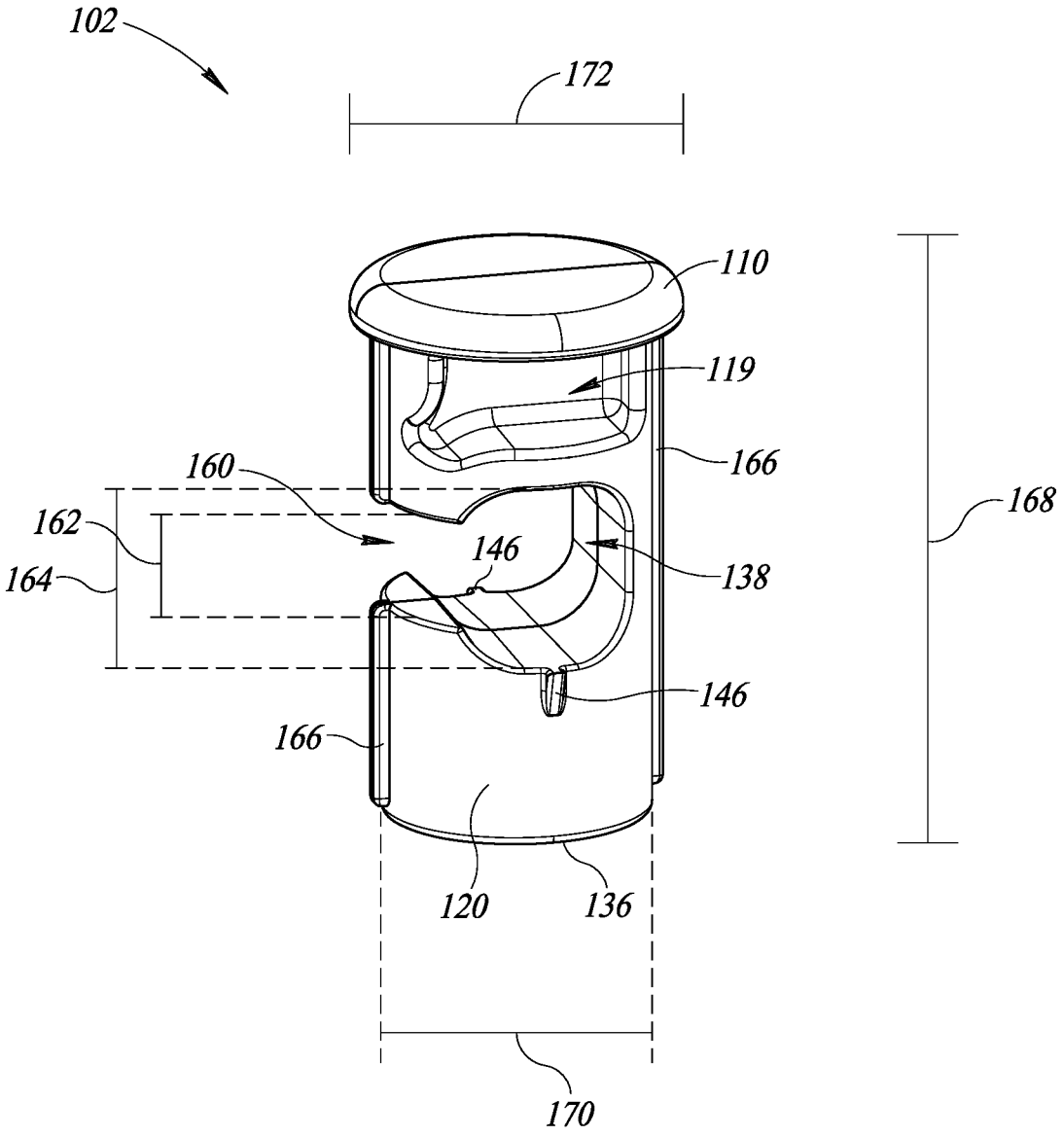
FIG. 3 is a perspective view of the inner housing of the clip of FIG. 1.

Turning now to FIG. 3, illustrated therein is the inner housing 102 showing features of the inner housing 102 in additional detail. The inner housing 102 includes sidewall 120 and the pair of opposing protrusions 146 extending from sidewall 120 proximate the cavity or bore 138, which extends through sidewall 120 of the inner housing 102 in a first direction. An opening 160, which may also be considered a side opening, extends through sidewall 120 of the inner housing 102 to connect or integrate with the cavity 138. The opening 160 extends through sidewall 120 of the inner housing 102 in a second direction that is transverse to the first direction wherein surfaces of the sidewall 120 defining the opening 160 are flat and planar. In an embodiment, the first direction is at a 90 degree angle to the second direction, while in other embodiments, the first direction is at an angle to the second direction that is more or less than 90 degrees. Because the opening 160 extends through sidewall 120 to the cavity 138, the opening 160 and the cavity 138 may generally be referred to as a singular opening or cavity, wherein the singular opening or cavity has a first portion corresponding to the opening 160 and a second portion corresponding to the cavity 138.

As shown in FIG. 3, the opening 160 has a maximum dimension 162 between outermost surfaces or edges of the sidewall 120 defining the opening 160 and similarly, the cavity 138 has a maximum dimension 164 between outermost surfaces or edges of the sidewall 120 defining the cavity 138. In the illustrated embodiment, the maximum dimension 162 corresponding to the opening 160 or the first portion is less than the maximum dimension 164 corresponding to the cavity 138 or the second portion. For example, the maximum dimension 162 is 3.5 mm or approximately 3.5 mm (i.e. between 3 and 4 mm) and the maximum dimension 164 is 5.2 mm or approximately 5.2 mm (i.e. between 4.75 and 5.5 mm) However, in other embodiments, the dimensions 162, 164 are the same or the dimension 162 is greater than the dimension 164. In this embodiment, the cavity 138 has smoothly rounded edges that form a C-shape. These smooth rounded edges are aesthetic features and these edges may have other shapes.

The inner housing 102 further includes a pair of opposing ridges or blades 166 extending along a height 168 of the inner housing 102. Although the pair of opposing ridges 166 are illustrated as extending from sidewalls 120 on both sides of the inner housing 102 over the entire height 168 of the inner housing 102, it is to be appreciated that embodiments of the present disclosure include the ridges 166 extending along a portion of the height 168 on either side of the inner housing 102 or on one side of the inner housing 102. As described herein, the ridges 166 assist with holding the inner housing 102 in position relative to the outer housing 104. Moreover, the ridges 166 provide additional support to sidewalls 120 of the inner housing 102 and the plate 110 of the inner housing. In an embodiment, the inner housing 102 includes a second recess 119, which may be identical, or substantially identical to first recess 118 on an opposite side of the inner housing 102. In other words, the second recess 119 is a mirror image of the first recess 118 about a vertical axis and as such, the recesses 118, 119 may generally be referred to as a pair of opposing recesses. However, in other embodiments, the recesses 118, 119 have a different size or shape, or in some embodiments, the inner housing 102 includes only one such recess.

Further, in an embodiment, the height 168 is between 15 and 25 mm, but more preferably is 18 mm or approximately 18 mm (i.e. between 17 and 19 mm). The inner housing 102 further includes a thickness 170, which may be a diameter in embodiments where the inner housing 102 is generally cylindrical, wherein the thickness 170 is between 5 and 15 mm, but more preferably is 8.9 mm or approximately 8.9 mm (i.e. between 8.5 and 9.5 mm). In this context only, the thickness 170 refers to the body of the inner housing 102, exclusive of the ridges 166 and exclusive of the plate 110. A maximum outer dimension 172, or diameter, in an embodiment, of the plate 110 is between 7 and 15 mm, but more preferably, is 11 mm or approximately 11 mm (i.e. between 10 and 12 mm).

Figure 4:
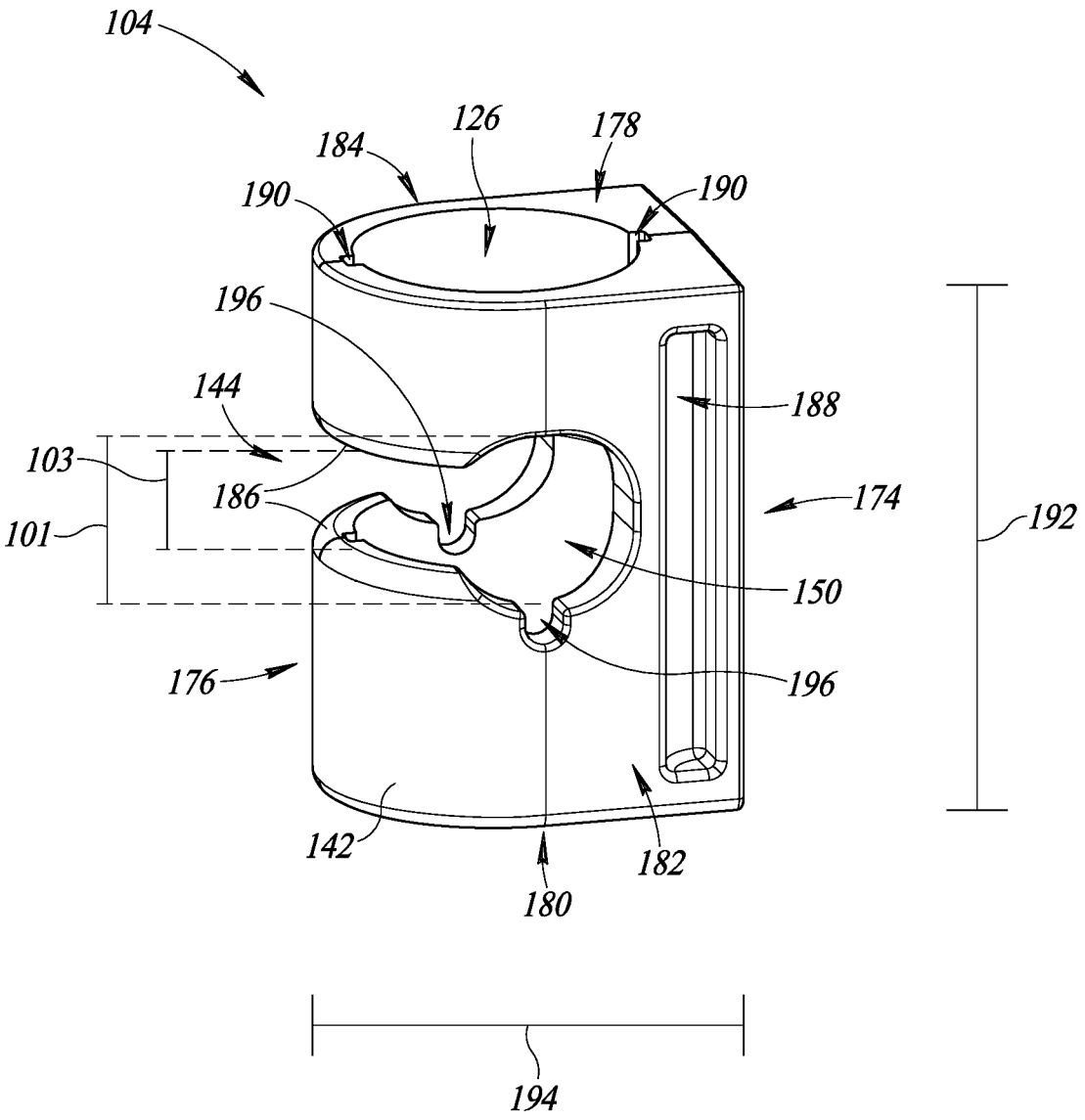
FIG. 4 is a perspective view of the outer housing of the clip of FIG. 1.

FIG. 4 illustrates the outer housing 104 in additional detail. The outer housing 104 includes a first surface 174 opposite a second surface 176, a third surface 178 opposite a fourth surface 180, and a fifth surface 182 opposite a sixth surface 184. The first surface 174 is preferably flat and planar so as to provide an even surface for bonding or coupling the decorative member 108 to the outer housing 104, and more specifically, the first surface 174 of the outer housing 104. Moreover, the second surface 176 is preferably curved or rounded. The third surface 178, which in an embodiment, is a top of the outer housing 104, is preferably flat and planar, as is the fourth surface 180, which in an embodiment, is a bottom of the outer housing 104. The fifth surface 182 and the second surface 184 are preferably flat and planar. However, in other embodiments, each of the surfaces may have different characteristics. For example, in an embodiment where the outer housing 102 has a square or rectangular cross section, each of the surfaces described herein may be flat and planar.

The outer housing 104 includes the cavity 150 extending through sidewalls 142 of the outer housing between the fifth surface 182 and the sixth surface 184 and a portion of the second surface 176. Further, the outer housing 104 includes the opening 144, which may also be referred to as a side opening, extending through the second surface 176. As with the inner housing 102, the cavity 150 and the opening 144 of the outer housing 104 may generally be referred to as a single cavity or opening, in which case, the singular cavity or opening includes a first portion corresponding to the opening 144 and a second portion corresponding to the cavity 150. Moreover, edges 186 of the sidewall 142 of the outer housing 104 that define opening 144 are preferably rounded. Round edges 186 prevent potential discomfort or injury to a user when trying to insert an objection through opening 144, and also generally assist with inserting an object into opening 144.

The outer housing 104 further includes a pair of recesses 188, with one recess 188 extending into the fifth surface 182 and one recess 188 extending into the sixth surface 184, as illustrated in FIG. 1. The recesses 188 are proximate the first surface 174 and are aligned vertically in the orientation shown in FIG. 4. Although the recesses 188 are not required, the recesses 188 allow for more efficient manufacturing of the outer housing 104 because the recesses 188 prevent bubbling or cracking in certain embodiments where the material comprising the outer housing 104 is plastic. In addition, if recesses are selected, a shape of the recesses including a depth, contours of the edges, and other features can be selected to have different visual characteristics. The recesses 188 extend along at least 50% of a height 192 of the outer housing 104, but more preferably, extend along at least 80% of the height 192 of the outer housing 104.

A pair of opposing channels 190 extend along the height 192 of the outer housing 104 and extend into sidewalls 142 of the outer housing 104 along the axial bore 126. Each of the channels 190 has a size and a shape to slidably receive corresponding ones of the pair of ridges 166 so as to hold the inner housing 102 in position relative to the outer housing 104, with the opening 144 of the outer housing 104 aligned with the opening 160 of the inner housing 102 when the inner housing 102 is in the second position, as described below with reference to FIG. 5. The cavity 150 of the outer housing 104 further includes a pair of opposing recesses 196 extending into sidewalls 142 of the outer housing 104, wherein each recess 196 has a size and a shape to receive corresponding ones of the pair of opposing protrusions 146 of the inner housing 102 when the inner housing 102 is in the second or open position as described herein.

The height 192 of the outer housing 104 is between 15 and 25 mm, but more preferably is 18 mm or approximately 18 mm (i.e. between 17 and 19 mm). Moreover, a thickness 194 of the outer housing 104 between the first surface 174 and the second surface 176 is between 8 and 15 mm, but more preferably, is 11.7 mm or approximately 11.7 mm (i.e. between 11 and 12 mm). The cavity 150 of the outer housing 104 includes a maximum dimension 101, exclusive of the recess 196, that is greater than a maximum dimension of the opening 144 of the outer housing 104. In an implementation, the maximum dimension 101 of the cavity 150 of the outer housing 104 is equivalent to the maximum dimension 164 of the cavity 138 of the inner housing. Similarly, the maximum dimension 103 of the opening 144 of the outer housing 104 is equivalent to the maximum dimension 162 of the opening 160 of the inner housing 102.

FIG. 5 illustrates the clip 100 and more specifically, the inner housing 102 in a second, or open position. In the second position, each of the pair of opposing protrusions 146 of the inner housing 102 are received in corresponding ones of the pair of opposing recesses 196 in the cavity 150 of the outer housing 104. Moreover, the cavity 150 of the outer housing 104 is aligned with the cavity 138 of the inner housing 102 and similarly, the opening 144 of the outer housing 104 is aligned with the opening 162 of the inner housing 102, such that a user can insert an object, such as shoelaces, for example, through the openings 144, 160 to be received in the cavities 138, 150.

FIG. 5 further illustrates that the decorative member 108 has a height 105 that is between 30 and 40 mm, but more preferably is 35.5 mm or approximately 35.5 mm (i.e. between 34 and 37 mm). The decorative member 108 also has a thickness 107 that is between 1 mm and 7 mm, but more preferably is 4 mm or approximately 4 mm (i.e. between 3.5 and 4.5 mm). A width 109 of the decorative member 108 is between 20 and 30 mm, but more preferably, is 24.5 mm or approximately 24.5 mm (i.e. between 23 and 26 mm).

In operation, and with reference to FIGS. 1-5, a user first ties their shoelaces into a typical shoelace knot. Then, the user picks up clip 100, which is initially in the first position illustrated in FIG. 1, and applies a compressive force F to the plate 110 of the inner housing 102 as in FIG. 5. The compressive force compresses spring 106, which causes the inner housing 102 to slide into the outer housing 104, with the ridges 166 and corresponding channels 190 holding the inner housing 102 in place relative to the outer housing 104, such that the inner housing 102 translates without rotating out of position. Once the inner housing 102 reaches the second position illustrated in FIG. 5, the user inserts shoelaces through the opening 144 of the outer housing 104, aided, in an embodiment, by rounded edges 186 of the outer housing that define, in part, the opening 144. The user continues to move the shoelaces through the opening 160 of the inner housing 102, such that the shoelaces are received in the cavities 138, 150 of the inner housing 102 and the outer housing 104, respectively. Once the shoelaces are secured in the cavities 138, 150, the user removes or relaxes the compressive force F on the plate 110 of the inner housing 102.

When the force F is less than the force exerted by the spring 106, which in an embodiment, is 9.2 psi, the spring 106 will begin to return the inner housing 102 from the second position shown in FIG. 5 to the first position shown in FIG. 1. As the inner housing 102 reaches the second position, the shoelaces will be trapped between the inner housing 102 and the outer housing 104, as further described herein. More specifically, as the inner housing 102 returns to the second position, the area of overlap between the cavity 150 of the outer housing 104 and the cavity 138 of the inner housing 102 decreases, such that the shoelaces are secured against edges of the cavities 138, 150 by the force of the spring 106. The user can then repeat this process as necessary to adjust the clip 100 closer to the shoelace knot and repeat the process again for a second clip, which may be identical to clip 100, for the shoelaces on the other side of the shoelace knot, as further described herein. Once the shoelaces are received in the clip 100, the first surface 154 of the decorative member 108 will be facing outward relative to the user's shoes, such that the decorative or safety features on the first surface 154 are visible to others.

Figure 6:
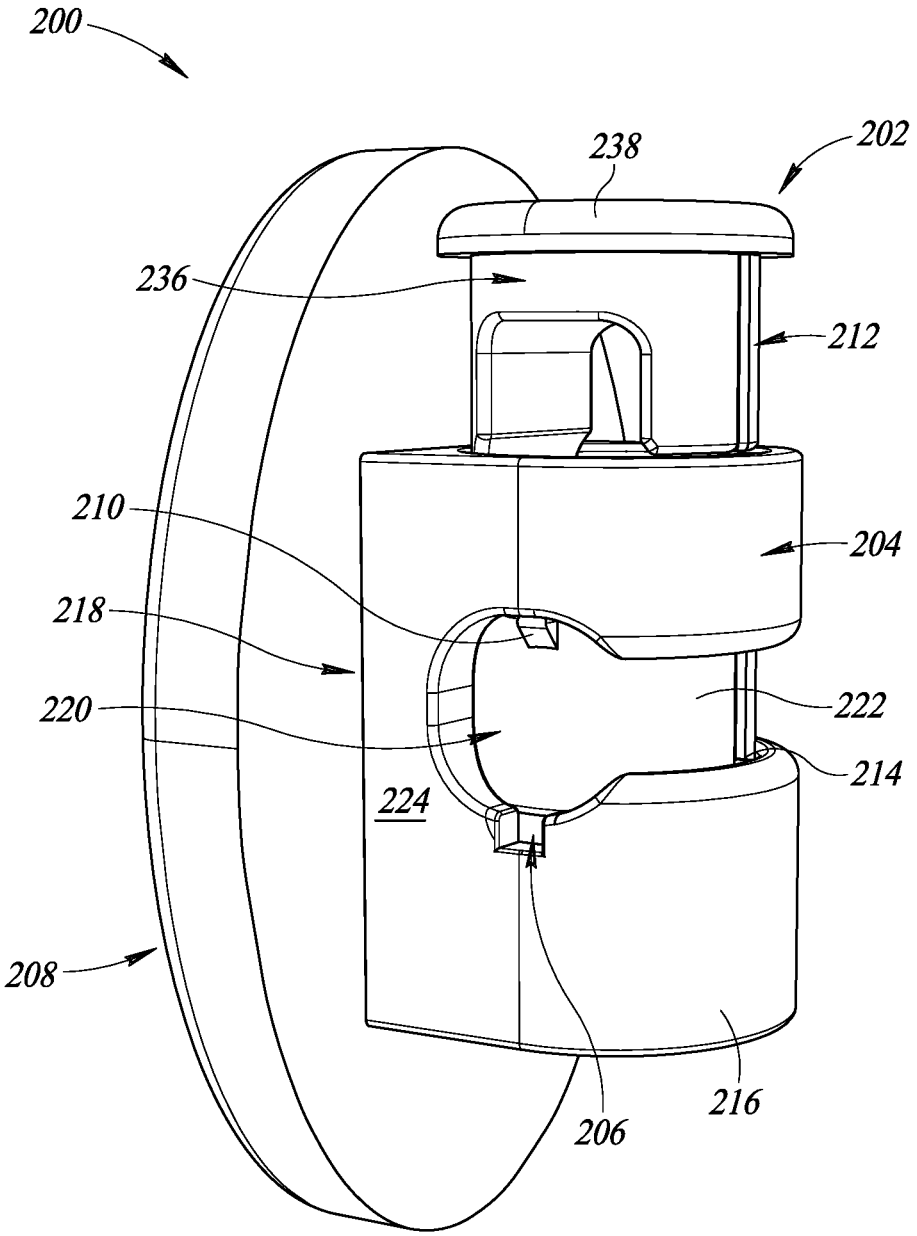
FIG. 6 is a perspective view of an embodiment of a clip according to the present disclosure with a side opening and illustrated in a first position.

FIG. 6 illustrates an embodiment of a clip 200 according to the present disclosure. Certain features of the clip 200 are identical or substantially identical to the clip 100 and as such, in the interest of efficiency, the description of such features has not been repeated herein with reference to clip 200. The clip 200 includes a housing 204 and a body 202 slidably received in the housing 204. In general, the clip 200 operates similarly to the clip 100 and as such, while the clip 200 is illustrated in a first, or closed position, it is to be understood that the clip 200 is manipulatable to a second, open position, as described herein with reference to FIGS. 1-5.

The body 202 includes at least one protrusion 210 extending from sidewalls 222 of the body 202, wherein the at least one protrusion 210 is received in a correspondingly sized and shaped recess 206 formed in sidewalls 216 of the housing 204. More specifically, the recess 206 extends into sidewalls 216 of the housing 204 at an edge of a cavity 220 extending through the housing 204. In this embodiment, the recess 206 has a generally square or rectangular shape with flat and planar sidewalls and the protrusion 210 has a corresponding rectilinear shape. Moreover, the body 202 includes channels 212 extending into sidewalls 222 of the body 202, wherein the housing 204 includes corresponding ridges 214. The ridges 214 are received in the channels 212 to align the body 202 with the housing 204, which is the inverse structure from the ridges 166 on the inner housing 102 and the corresponding channels in the outer housing 104 described above.

A decorative member 208 is coupled to the housing 204 at a first surface 218 of the housing 204. Sidewalls 216 of the housing 204 include a portion 224 between boundaries of the cavity 220 of the housing 204 and the first surface 218 of the housing 204, wherein in this embodiment, the portion 224 is flat and planar and does not include a recess or depression. The body 202 further includes a portion 236 between the cavity 226 of the body 202 and a plate 238 or button of the body 202, wherein in this embodiment, the portion 236 includes the sidewalls 222 of the body 202 extending continuously from an outer edge of the cavity 226 to the plate 238. In other words, as compared to the inner housing 102, there are no recesses, indentations, depressions, or cavities in the portion 236 between the plate 238 and the cavity 226 of the body 202.

Figure 7:
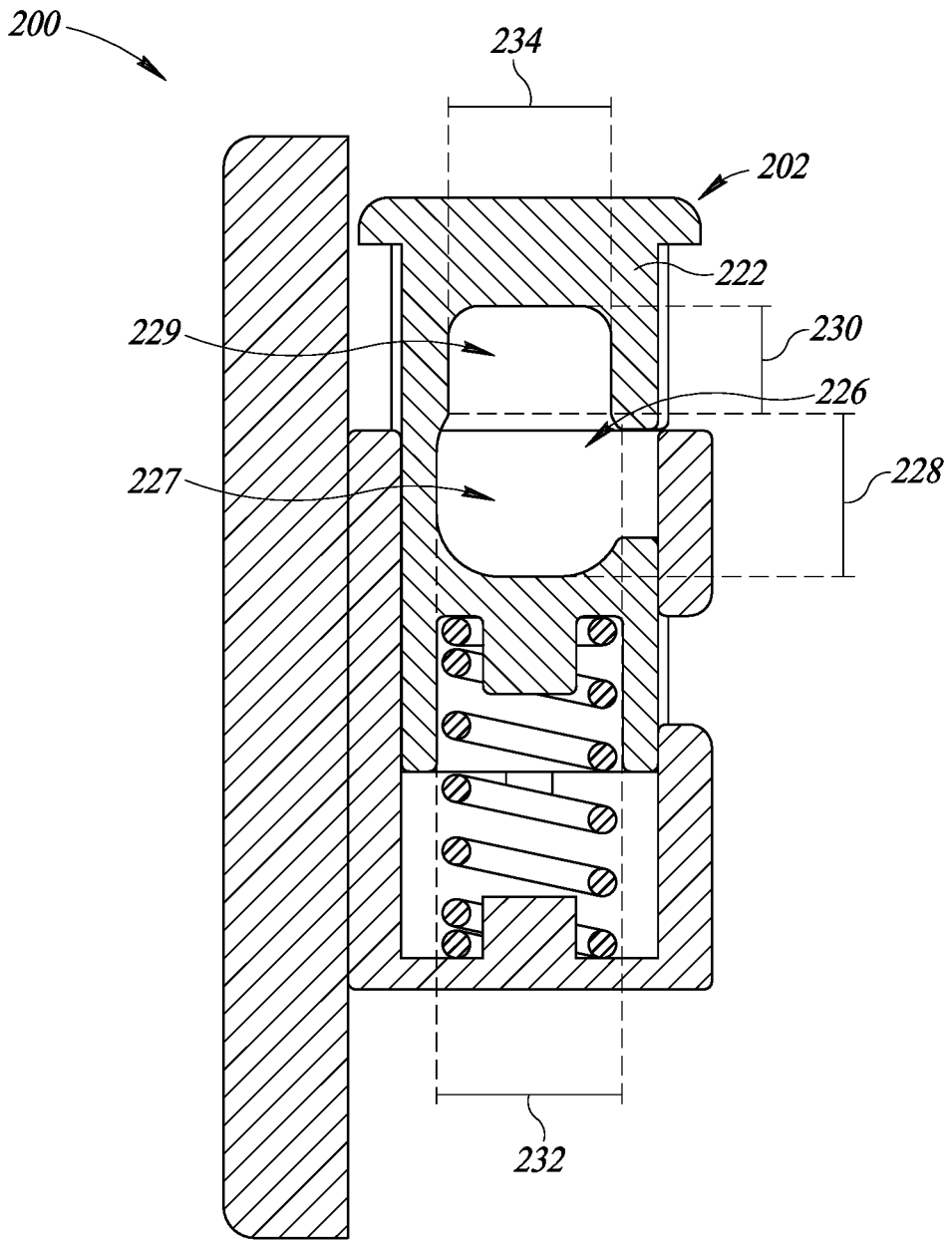
FIG. 7 is a cross-sectional view of the clip of FIG. 6 showing a spring between the inner and outer housings of the clip.

Turning to FIG. 7, the body 202 includes a cavity 226 extending through sidewalls 222 of the body 202. However, the cavity 226 has a different size, shape, and arrangement, than cavity 138 of the inner housing 102 described with reference to FIGS. 1-5. The cavity 226 includes a first portion 227 with a first height 228 that is 5.2 mm or approximately 5.2 mm (i.e. between 4.5 and 6 mm) and a second portion 229 with a second height 230 that is 2.5 mm or approximately 2.5 mm (i.e. between 1.5 and 4 mm). As such, an overall height of the cavity 226, which includes the first height 228 and the second height 230, is 8.7 mm or approximately 8.7 mm (i.e. between 8 and 9.5 mm) and the first height 228 is greater than the second height 230. Similarly, as shown in FIG. 7, a width 232 of the first portion 227 is greater than a width 234 of the second portion 229, wherein in an embodiment, the width 234 of the second portion is 5.3 mm or approximately 5.3 mm (i.e. between 4.5 and 6 mm), and as such, the width 232 is preferably greater than 5.3 mm.

Figure 8:
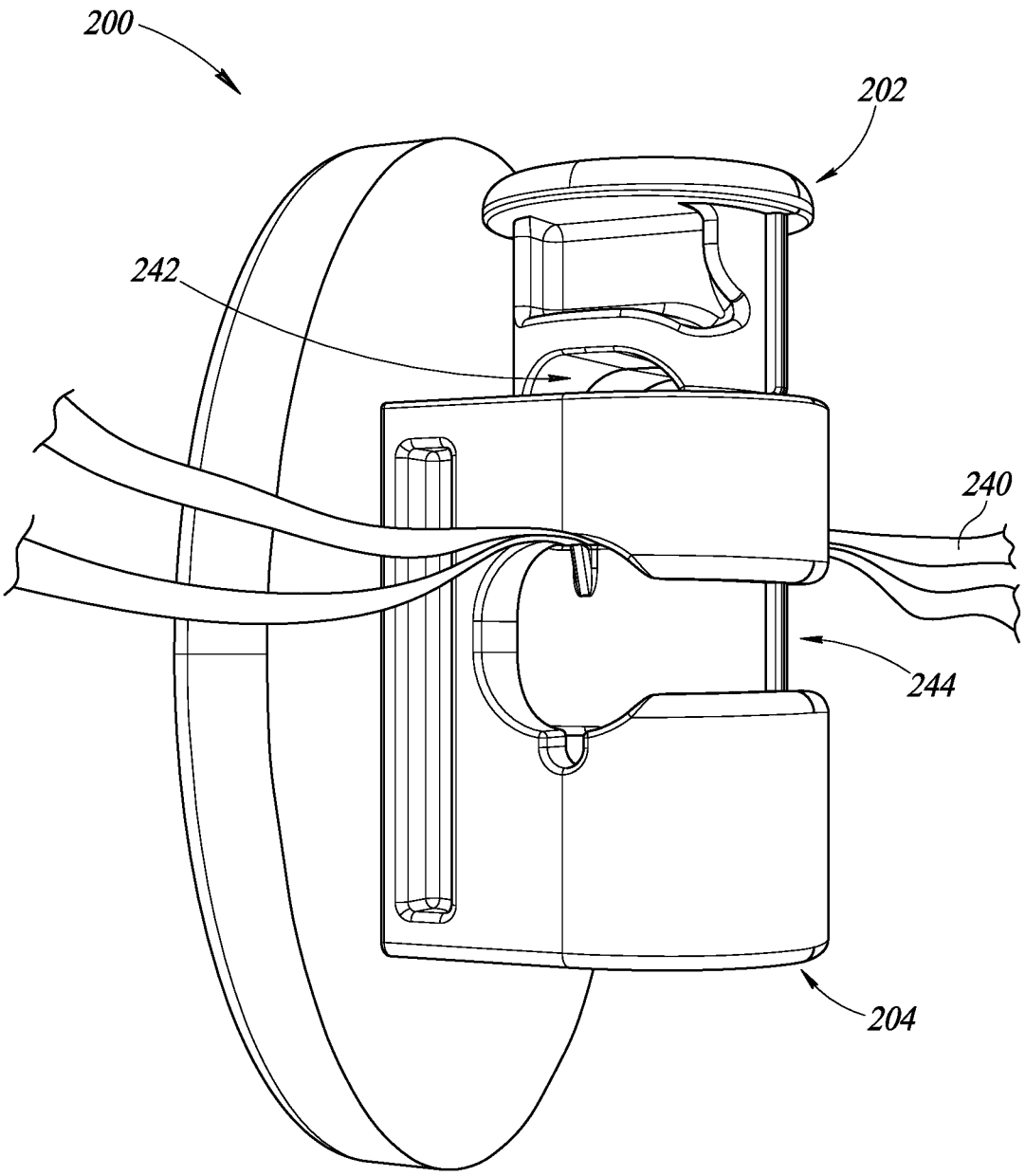
FIG. 8 is a perspective view of the clip of FIG. 6 illustrating a shoelace secured in the clip.

FIG. 8 illustrates the clip 200 coupled to a shoelace 240. However, the clip 200 could also be any of the clips described herein, such as clip 100 or 400, for example. In operation, a user manipulates the body 202 such that it is received in the housing 204 by applying a compressive force to the body 202. This compressive force aligns an opening 242 through the body 202 with an opening 244 through the housing 204. When the openings 242, 244 are aligned, the shoelace 240 can be inserted through openings 242, 244, as described herein. Then, the user releases the force on the body 202, wherein a spring of the type described herein biases the body 202 to the position shown in FIG. 8, which secures the shoelace 240 between the body 202 and the housing 204, as shown in FIG. 8.

The openings 242, 244 are large enough to accommodate several strands of the shoelace 240, such that an entire shoelace loop (e.g., two individual strands of shoelace 240) can be received and secured in the clip 200, as shown. In other embodiments, three strands (e.g. two strands from a shoelace loop and a strand for a tail of the shoelace) can be received in the clip 200. In further embodiments, more or less than two or three strands of a shoelace can be received in the clip 200. The spring of clip 200 maintains the body 202 in the position shown in FIG. 10 and provides a force on the shoelace 240 that prevents the clip 200 from sliding along the shoelace 240. The amount of force exerted by the user to manipulate the body 202 and the amount of force exerted by the clip 200 to secure the clip 200 to the shoelace 240 can be selected by selecting springs with different sizes, shapes, thicknesses, and elastic properties. It is noted that the clip 200 may be used to secure other strings or thin, flexible filament materials in place, such as for strings on jogging pants.

Figure 9:
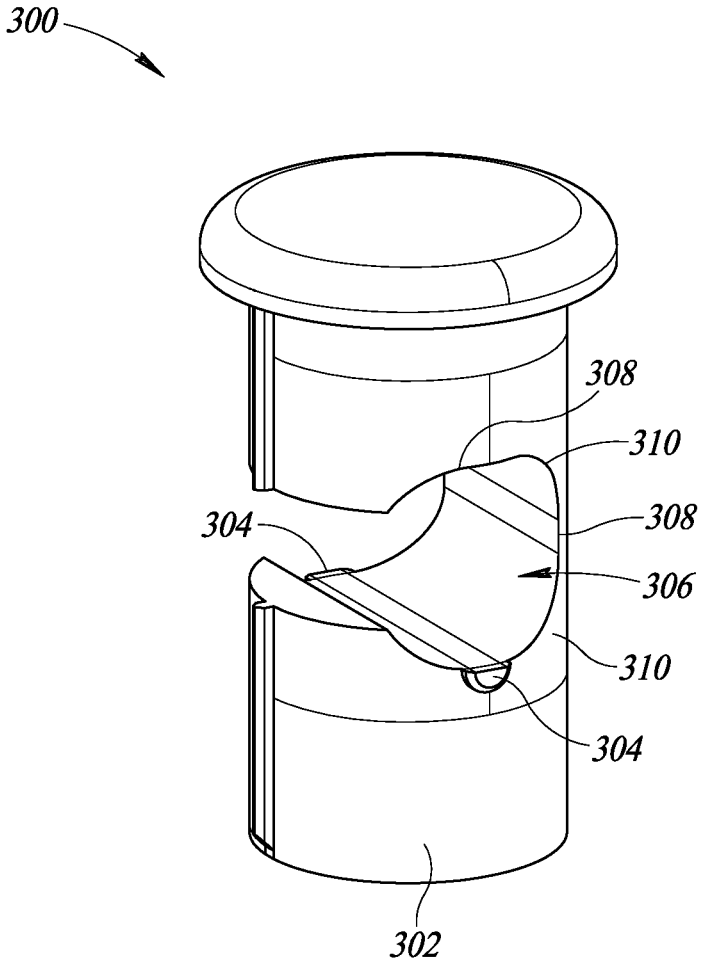
FIG. 9 is a perspective view of an embodiment of an inner body according to the present disclosure having continuous sidewalls from a cavity in the inner housing to a plate.

FIG. 9 illustrates an embodiment of an inner body 300. Inner body 300 includes features which are identical or substantially similar to those described above with reference to inner housing 102 and as such, in the interest of efficiency, such features have not been repeated in the description of the inner body 300. The inner body 300 includes sidewalls 302 and a pair of protrusions 304 extending from sidewalls 302 of the inner body 300. As illustrated herein, the protrusions 304 have a generally semi-circular shape. The inner body 300 further includes a cavity 306 extending through sidewalls 302 of the inner body 300, wherein the cavity 306 is defined by a plurality of straight edges 308 and a plurality of curved edges 310. As such, the cavity 306 generally has a square or rectangular shape with rounded edges.

Figure 10:
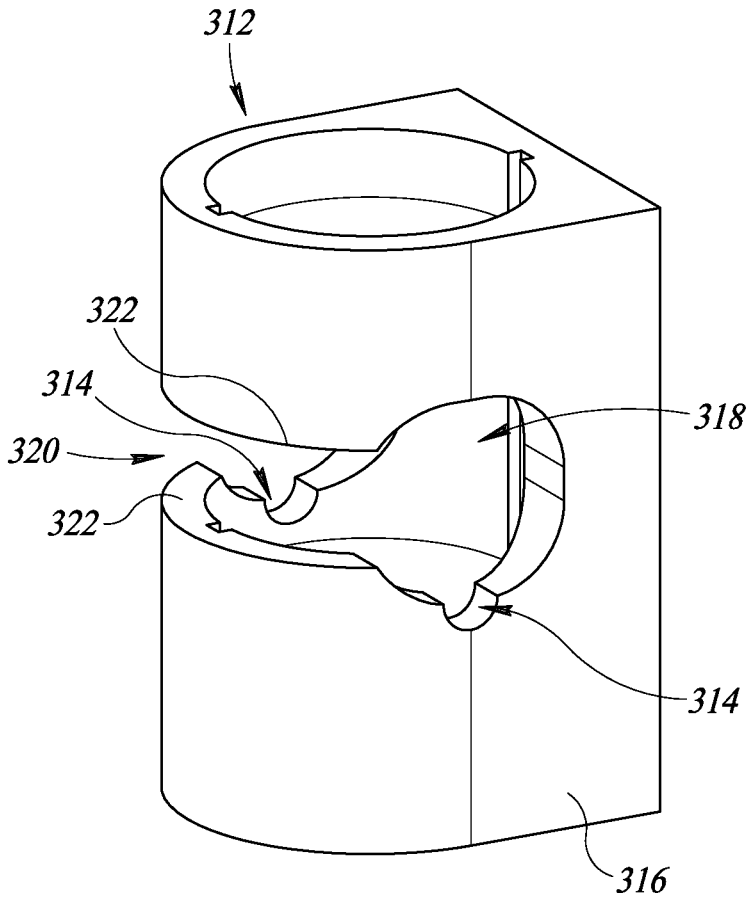
FIG. 10 is a perspective view of an embodiment of an outer body according to the present disclosure having straight edges defining a side opening in the outer housing.

FIG. 10 illustrates an embodiment of an outer body 312, which may also be referred to as an outer cylinder, wherein the inner body 300 is slidably received in the outer body 312, as described herein with reference to the inner housing 102 and the outer housing 104. Outer body 312 includes features which are identical or substantially identical to those described above with reference to outer housing 104 and as such, in the interest of efficiency, such features have not been repeated in the description of the outer body 312. Outer body 312 includes a cavity 318 extending through sidewalls 316 of the outer body 312, wherein a pair of recesses 314 extend into sidewalls 316 of the outer body 312 proximate the cavity 318. Each of the pair of recesses 314 has a size and a shape to receive corresponding ones of the pair of protrusions 304 described above with reference to FIG. 9 and as such, in an embodiment, the recesses 314 have a generally semi-circular shape.

Outer body 312 further includes a side opening 320, wherein edges 322 of sidewalls 316 that define the side opening 320 are square. In other words, edges 322 are a vertex between adjacent surfaces, wherein the angle between the surfaces is preferably 90 degrees. However, it is to be appreciated that in other embodiments, the angle is more or less than 90 degrees, such as with a chamfered edge.

As such, embodiments of the present disclosure provide for a clip that is easy to use, including for those with dexterity challenges. The clip preferably prevents shoelaces from becoming untied, although it can also be used in other situations where a typical spring lock clip would be appropriate, for example with a back pack. Further, the decorative member coupled to the clip provides an appealing design that is a positive addition to a user's shoes, which increases the appeal of the clip.

In further embodiments, the present disclosure is directed to a device having a first outer flat surface that is opposite a second outer rounded surface. The device includes a third outer surface that is coupled to the first and second surfaces and is transverse to these surfaces. The device includes a first opening opposite the third surface and transverse to the first and second surfaces. There are openings in the second outer rounded surface coupled to openings in sidewalls that extend from the third surface to the first opening.

An interior plug is slidably received in the first opening and includes a through hole around a middle section of the interior plug that aligns with the openings in the sidewalls when the plug is in a depressed condition. When in a released or relaxed position, the through hole of the plug is between the first opening and the openings in the sidewalls, in a locked position. In this locked position, shoe laces or other materials in plug are securely held in place.

Figure 11:
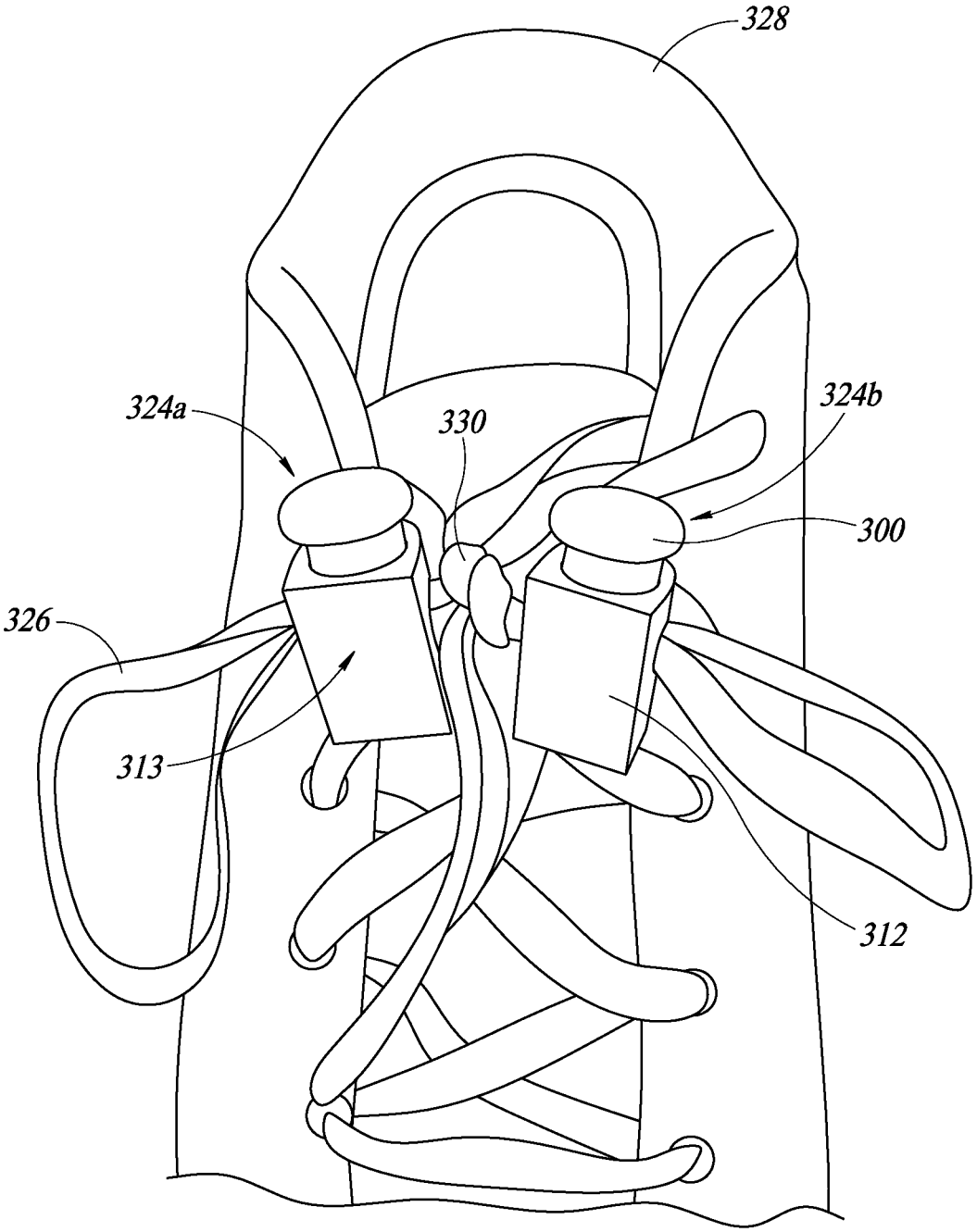
FIG. 11 is a perspective view of an embodiment of a pair of clips according to the present disclosure showing the clips secured to shoelaces of a shoe on opposite sides of a shoelace knot.

FIG. 11 illustrates a pair of clips 324*a*, 324*b* coupled to shoelaces 326 of a shoe 328. Each of the pair of clips 324*a*, 324*b* includes the inner body 300 of FIG. 9 slidably received in the outer body 312 of FIG. 10. In some embodiments, the clips 324*a*, 324*b* are the other clips described herein. As shown in FIG. 11, the shoelaces 326 are tied in a standard shoelace knot 330. Once the shoelaces are tied into the knot 330, the clips 324*a*, 324*b* are manipulated such that the shoelaces 326 on either side of the knot 330 are received and secured in the clips 324*a*, 324*b*. Then, the clips 324*a*, 324*b* prevent the shoelaces 326 from sliding and becoming untied. In other words, the shoelaces 326 cannot become untied because the clips 324*a*, 324*b* will not fit through the knot 330, even if the knot 330 is loosened to some degree from its originally tied configuration. Moreover, when both strands of the loops of the shoelaces 326 are received in the clips 324*a*, 324*b*, the strands of the shoelaces 326 are immobilized, which prevents the knot 330 from becoming loose in the first place. Thus, the clips 324*a*, 324*b* assist with keeping the shoelaces 326 in the tied configuration illustrated in FIG. 11.

Each clip includes a surface 313, that is planar that is illustrated as facing away from the shoe 328. The surface 313 may be colored or decorated with a pattern. An opposite side from the surface 313 is a rounded or curved surface through which the laces and the inner body 300 and the outer body 312 interact.

Figure 12:
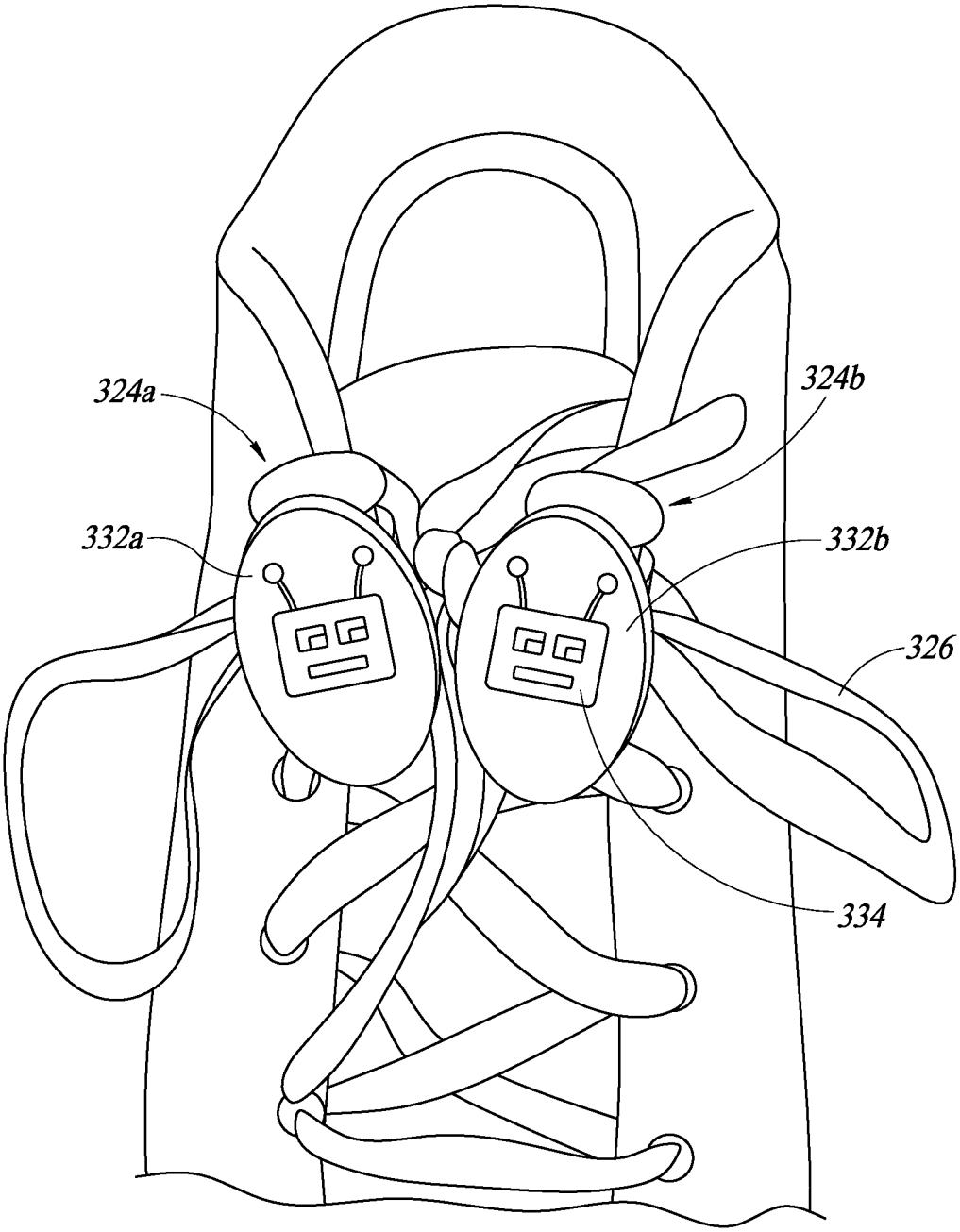
FIG. 12 is a perspective view of the pair of clips of FIG. 11 illustrating a front plate with a design coupled to each of the pair of clips.

FIG. 12 illustrates the clips 324*a*, 324*b* of FIG. 11 with decorative elements 332*a*, 332*b* coupled to the clips 324*a*, 324*b*, respectively. As shown in FIG. 12, each of the decorative elements 332*a*, 332*b* includes a design 334 on a surface facing away from the clips 324*a*, 324*b* (e.g., an outwardly facing surface when the clips are coupled to the shoelaces 326), such that the design 334 is visible when the clips 324*a*, 324*b* are secured to the shoelaces 326. The decorative elements 332*a*, 332*b* are structured to be removable from the clips 324*a*, 324*b*, and replaced with other decorative elements with different designs, in some embodiments. As such, the clips 324*a*, 324*b* can be sold in a kit with different decorative elements 332*a*, 332*b* and adhesives or other fasteners, such as adhesive strips. In some embodiments, the clips 324*a*, 324*b* are permanently affixed to the decorative elements 332*a*, 332*b*. The decorative elements 332*a*, 332*b* improve the aesthetic of the clips 324*a*, 324*b* such that they are viewed as a fashion accessory as opposed to a shoelace aid.

Figure 13:
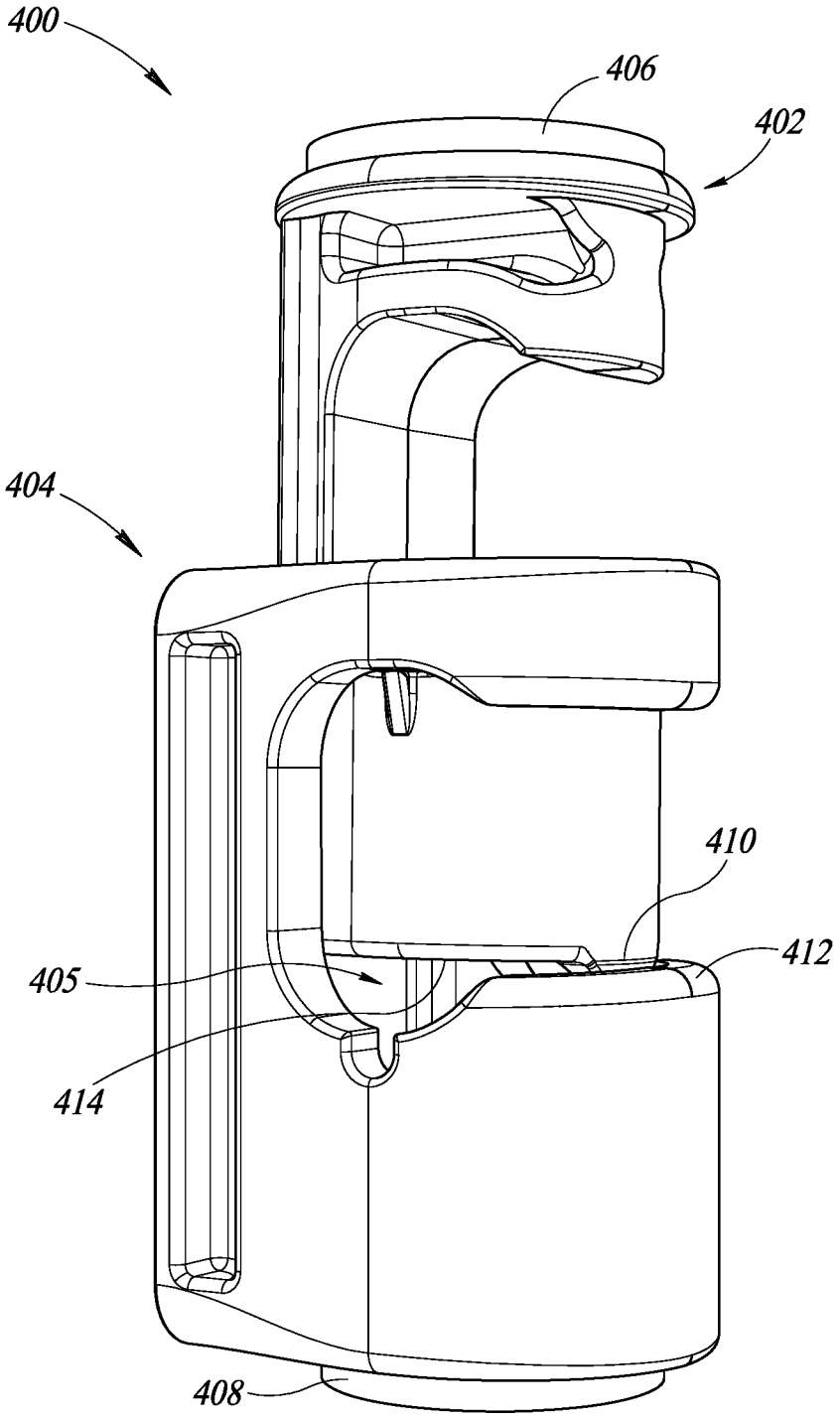
FIG. 13 is a perspective view of an embodiment of a clip according to the present disclosure showing pads coupled to the clip.

FIGS. 13-18 illustrate a further embodiment of a clip 400. With reference to FIG. 13, the clip 400 includes an inner body 402 and an outer body 404. The inner body 402 is slidably received in an axial bore 405 extending into the outer body 404 and a spring is received internally to the clip 400, as described herein. A first pad 406 is coupled to the inner body 402 and a second pad 408 is coupled to the outer body 404. In some embodiments, the first pad 406 is coupled to a top of the inner body 402 and the second pad 408 is coupled to a bottom of the outer body 404. The first pad 406 and the second pad 406 may be formed of rubber, silicon, plastic, thermoplastic, polymers, or other like materials. The pads 406, 408 provide a cushion for the fingers of a user when the user attempts to manipulate the inner body 402 relative to the outer body 404. In some embodiments, the pads 406, 408 have a coefficient of friction that is higher than a coefficient of friction than the bodies 402, 404, such that the pads 406, 408 provide grip to the user when attempting to manipulate the bodies 402, 404. As such, the pads 406, 408 may also be referred to herein as cushions or grips. The pads 406, 408 have a circular shape in some embodiments. In some embodiments, the pads 406, 408 have a different shape, such as a square, rectangle, triangle, trapezoid, oval, or other like shapes. Further, while the pads 406, 408 are illustrated with flat and planar surfaces meeting at rectilinear edges or sharp corners, it is to be appreciated that edges of the pads 406, 408 can be rounded or chamfered in some embodiments to further improve the tactile response to the user.

The inner body 402 further includes a protrusion 410 extending from the inner body 402 into the axial bore 405 of the outer body 404 when the clip 400 is in the closed position shown in FIG. 13. More specifically, when the clip 400 is in the closed position, the protrusion 410 extends beyond a lip 412 of the outer body 404 around the axial bore 405 to reduce the likelihood that an edge 414 of the inner body 402 will catch on the lip 412 of the outer body 404 when the user attempts to manipulate the clip 400. As shown in FIG. 13, the edge 414 of the inner body 402 is the bottom edge of the inner body 402. The protrusion 410 extends from the edge 414 of the inner body 402 into the axial bore 405 of the outer body 404 beyond the lip 412 of the outer body 404. As such, the protrusion 410 may also be referred to herein as a guide or a guide protrusion. In some embodiments, the clip 400 has a size and shape similar to the clips described herein. In some embodiments, the clip 400 is slightly larger than the clips described herein. For example, the clip 400 may be between 1-2 mm larger than the clips described herein. Specifically, a size of the cavity for receiving the shoelaces is slightly increased and a length of the clip 400 is slightly increased, such that the clip 400 extends beyond and above an outer edge of a decorative element coupled to the clip 400.

Figure 14:
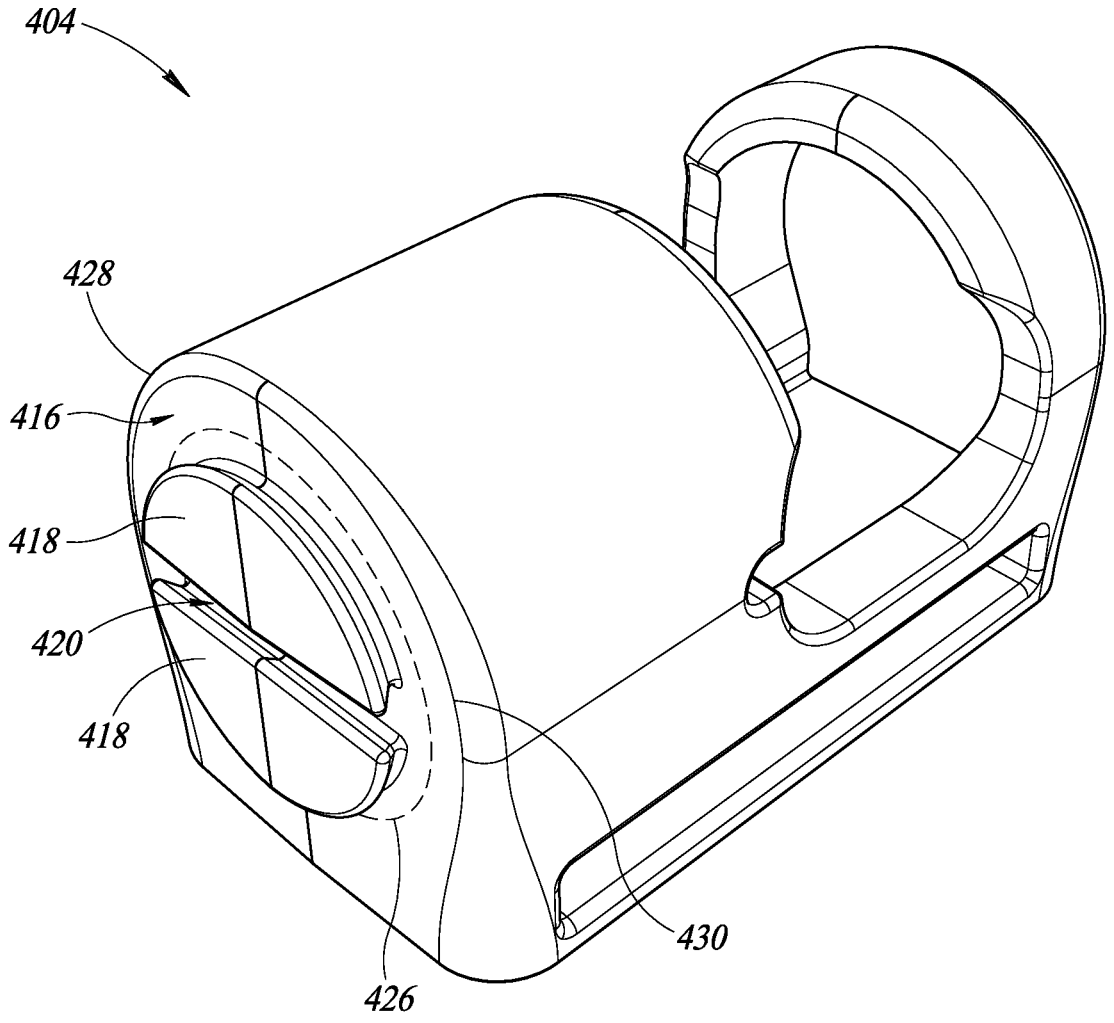
FIG. 14 is a perspective view of an outer body of the clip of FIG. 13 illustrating protrusions of the outer body structured to receive and secure one of the pads.
Figure 15:
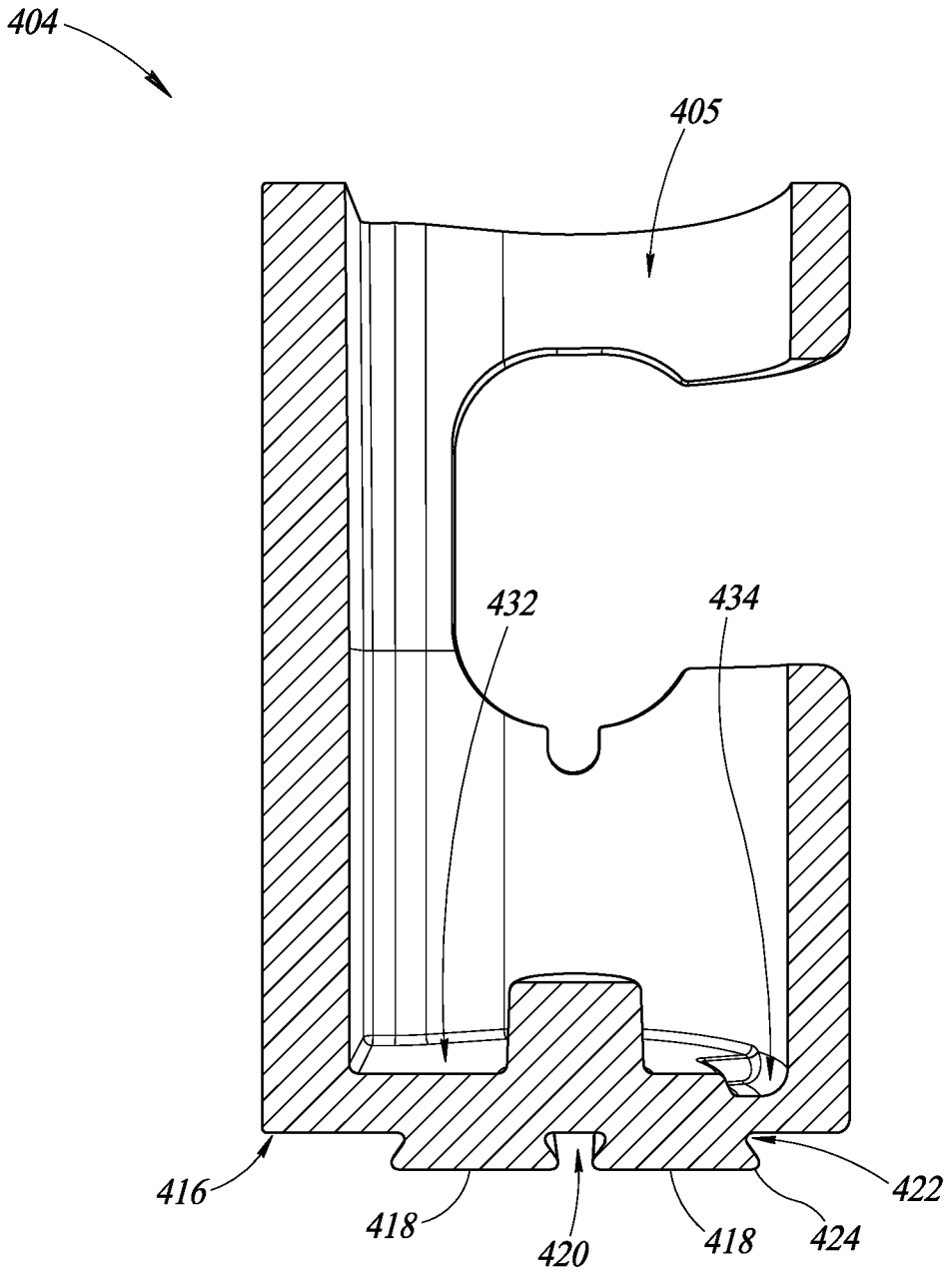
FIG. 15 is a cross-sectional view of the outer body of FIG. 14 illustrating the protrusions in more detail.
Figure 16:
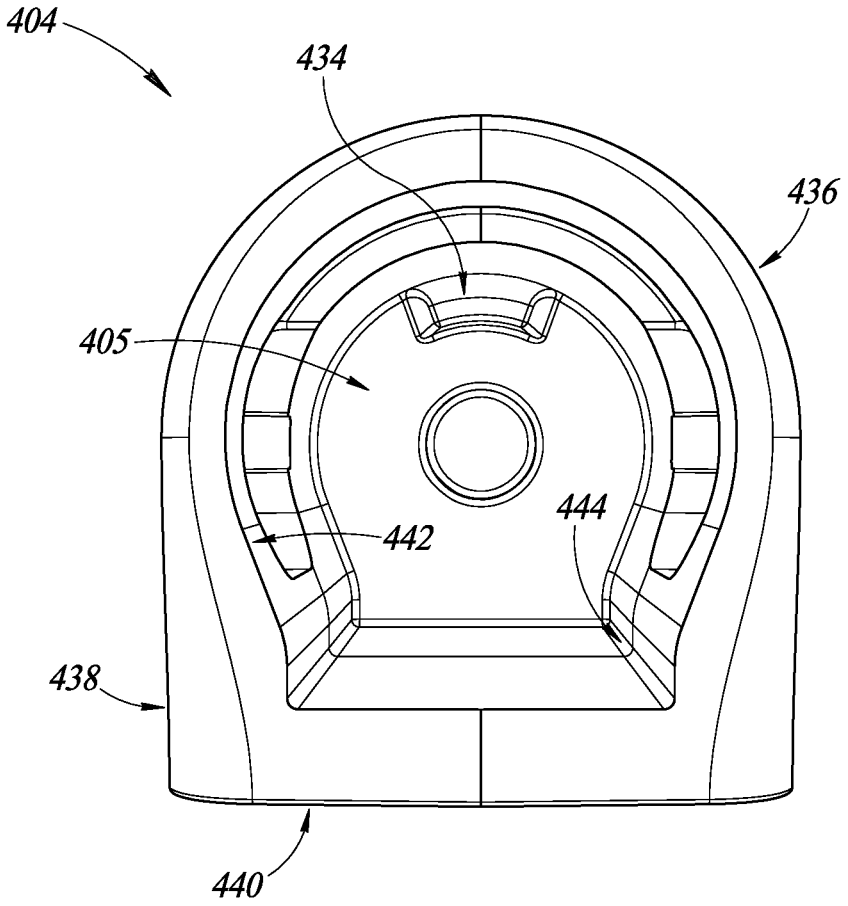
FIG. 16 is a top plan view of the outer body of FIG. 14 illustrating a shape of an axial bore of the outer body.

FIGS. 14-16 illustrate the outer body 404 of the clip 400 in more detail. The outer body 404 includes a first surface 416, which in an embodiment, is a bottom or lower exterior surface of the outer body 404. The outer body 404 includes protrusions 418 extending from the first surface 416 to provide a mechanical coupling point for the pad 408. The protrusions are separated by a space 420, as shown in FIG. 15. Although FIGS. 14-16 illustrate that there are two protrusions 418, embodiments of the present disclosure include more or less than two protrusions 418, such as only one protrusion 418 or three, four, five, six, or more protrusions 418. As shown in FIG. 15, each of the protrusions 418 have a generally trapezoidal shape with recesses 422 extending into the protrusions between an outer peripheral edge 424 of the protrusions 418 and the first surface 416. The shape of the protrusions 418 and the recesses 422 assist with forming a strong mechanical bond with the pad 408. In one embodiment, the pad 408 is applied as a liquid or melted liquid and is cured in place on the outer body 404, such that the pad 408 fills the space 420 and the recesses 422. In other embodiments, the pad 408 is manufactured with corresponding ridges for the space 420 and the recesses 422 and corresponding cavities to receive the protrusions 418, in which case, the pad 408 can be coupled to the outer body 404 and the protrusions 418 with standard adhesives or fasteners. In other words, the size and shape of the pad 408 corresponds to the size and shape of the protrusions 418, including the space 420 and the recesses 422, in some embodiments.

Together, the protrusions 418 generally define a circular area for attaching to a circular pad 408. However, other shapes and arrangements of the protrusions 418 are contemplated herein to correspond to the shapes of the pad 408 described above. Returning to FIG. 14, dashed line 426 corresponds to an outer edge of the pad 408 shown in FIG. 13 when the pad 408 is coupled to the outer body 404. The outer edge 426 of the pad 408 is spaced from an outer edge 428 of the outer body 404. In some embodiments, the outer edge 428 of the outer body 404 is rounded or curved. As such, the outer edge 426 of the pad 408 can be spaced from the curved portion of the edge 428 of the outer body 404. In some embodiments, the outer edge 426 of the pad 408 is proximate to or adjacent the outer edge 428 of the outer body 404. In other words, the outer edge 426 of the pad 408 is aligned with contour line 430, which represents the beginning of the curvature of the outer edge 428 of the outer body 404.

While it is possible to form a pad 408 extending beyond the edge 428 of the outer body 404, this arrangement may result in the pad 408 uncoupling from the protrusions 418 if the pad 408 catches on an external object and is peeled back from the outer body 404 by the object. As such, the outer edge 426 of the pad 408 is preferably disposed spaced from the outer edge 428 of the outer body 404 or in some embodiments, aligned with the outer edge 428 of the outer body 404 without extending beyond the outer edge 428 of the outer body 404 in order to reduce the likelihood of the pad 408 uncoupling from the outer body 404.

The outer body 404 further includes a second surface 432, which in an embodiment, is a bottom surface of the axial bore 405, as well as a recess or cavity 434 extending into the second surface 432. The recess 434 is sized and shaped to receive the protrusion 410 of the inner body 402, such that when the inner body 402 is received completely within the axial bore 405 as a result of a force applied by the user, the protrusion 410 of the inner body is received in the recess 434 in order to allow the clip to open completely.

FIG. 16 illustrates the shape of the outer body 404 in additional detail, including the shape of the axial bore 405. The outer body 404 has a cylindrical portion 436 integral with a rectangular portion 438 in order to provide a flat and planar surface 440 for receiving a decorative element. The axial bore 405 extends into the outer body 404 with a similar shape. More specifically, the axial bore 405 defines a corresponding cylindrical portion 442 on an interior of the outer body 404 that is integral with a rectangular portion 444 on an interior of the outer body, such that an interior surface of the outer body 404 includes both curved surfaces corresponding to the cylindrical portion 442 as well as flat and planar surfaces corresponding to the rectangular portion 444. As will be described in further detail below, the inner body 402 has a similar shape to the axial bore 405 of the outer body 404, which prevents the inner body 402 from rotating in place about a vertical axis relative to the outer body 404.

Figure 17:
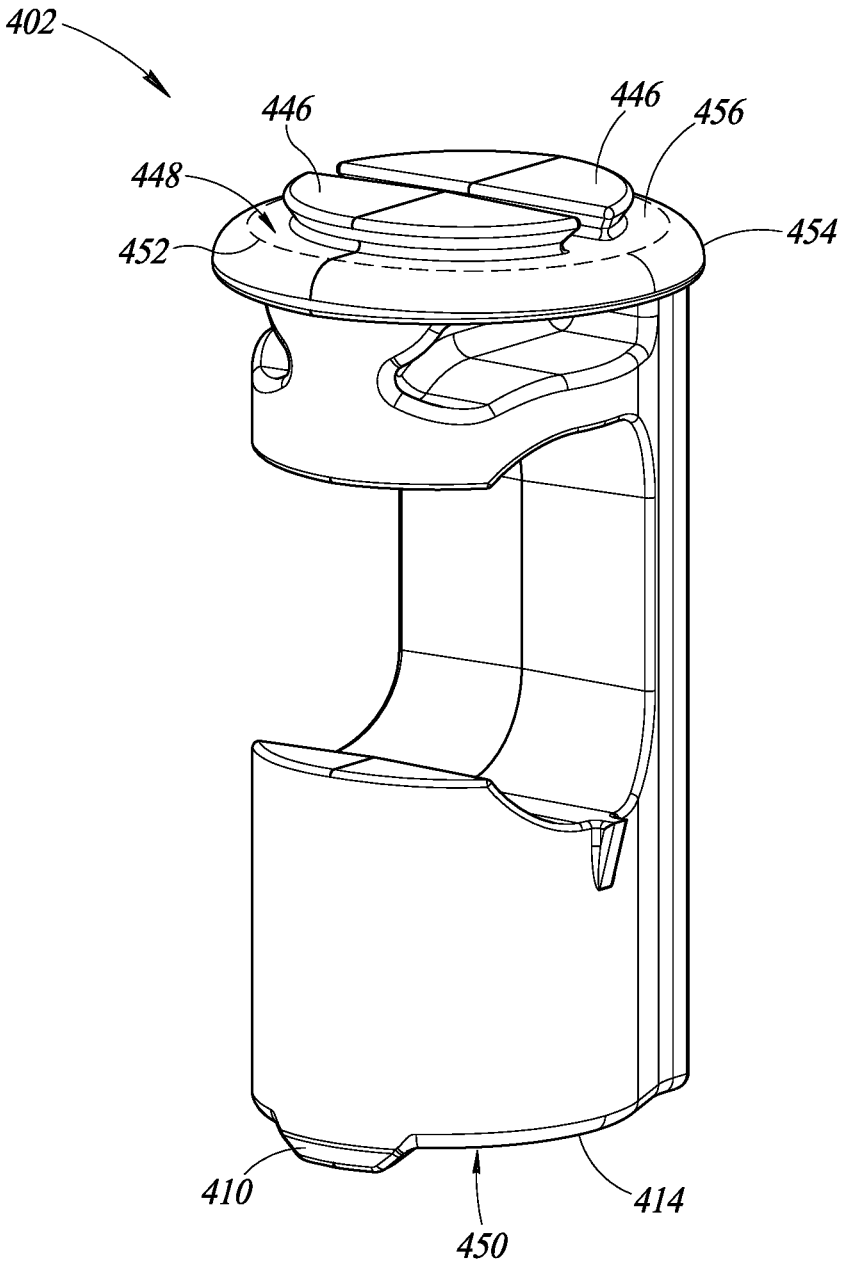
FIG. 17 is a perspective view of an inner body of the clip of FIG. 13 illustrating a first pair of protrusions and a second protrusion on opposite sides of the inner body.
Figure 18:
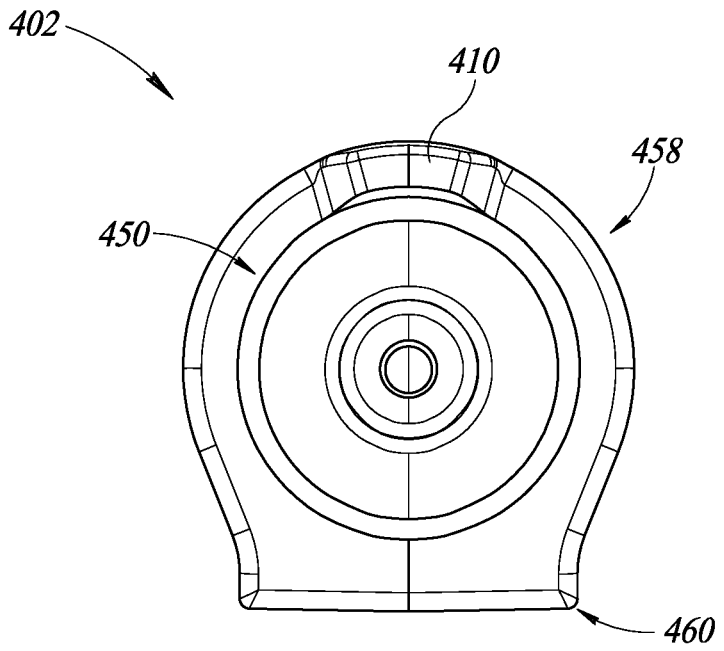
FIG. 18 is a bottom plan view of the inner body of FIG. 17 illustrating a shape of the inner body.

FIGS. 17-18 illustrate details of the inner body 402. The inner body 402 includes the protrusion 410 extending from the edge 414. In some embodiments, the protrusion 410 has a trapezoidal shape with rounded corners, as shown in FIG. 17. However, other shapes for the protrusion 410 are contemplated herein, such as a square, ovular, circular, rectangular, trapezoidal, or other like shapes. Further, in some embodiments, the protrusion 410 has rectilinear corners meeting at sharp edges as opposed to rounded corners. In yet further embodiments, the corners are chamfered or filleted.

The inner body 402 further includes a pair of protrusions 446 extending from a first surface 448 of the inner body 402. In some embodiments, the first surface 448 is a top or upper surface of the inner body 402. The inner body 402 also includes a second surface 450, which in some embodiments, is a bottom or lower surface of the inner body 402. As such, the pair of protrusions 446 extend from the top of the inner body 402 while the protrusion 410 extends from the bottom of the inner body 402. In other words, the pair of protrusions 446 extend in an opposite direction from the protrusion 410. The pair of protrusions 446 are identical to the protrusions 418 of the outer body 404, in some embodiments. In one or more embodiments, the pair of protrusions 446 have the same shape and arrangement as the protrusions 418 of the outer body 404, but are slightly smaller in size. In yet further embodiments, the pair of protrusions 446 have a different, size, shape, arrangement, number, or any combination thereof with respect to the protrusions 418 of the outer body 404. The pair of protrusions 446 are structured to receive the pad 406 in a similar manner that the protrusions 418 of the outer body 404 receive the pad 408.

FIG. 17 further illustrates a dashed line 452 representing an outer edge of the pad 406 from FIG. 13. In some embodiments, the outer edge 452 of the pad 406 is positioned at an interface between a curved portion 454 and a flat and planar portion 456 of the first surface 448 of the inner body 402. In other words, the outer edge of the pad 406, as represented by dashed line 452, covers the entire flat and planar portion 456 of the first surface 448, but does not extend to the cover any portion of the curved portion 454 of the first surface 448. This position of outer edge 452 of the pad 406 reduces the likelihood of peeling and separation of the pad 406 from the inner body 402 while maximizing the size of the pad 406 to improve the tactile response to the user regardless of where the user attempts to contact the first surface 448 of the inner body 402. In some embodiments, the outer edge 452 of the pad 406 is positioned spaced from the interface between the curved and flat portions 454, 456 while in further embodiments, the pad 406 extends beyond the flat portion 456 to cover some or all of the curved portion 454. The pad 406 may even extend beyond the curved portion 454 in some embodiments.

FIG. 18 illustrates that the inner body 402 has a shape that corresponds to the shape of the axial bore 405 in the outer body 404 described with reference to FIG. 16. Specifically, the inner body 402 includes a cylindrical portion 458 integral with a rectangular portion 460. The cylindrical portion 458 of the inner body 402 includes curved exterior surfaces that have same radii of curvature of the curved inner surfaces of the cylindrical portion 442 defined by the axial bore 405 of the outer body 404. Similarly, the rectangular portion 460 of the inner body 402 has flat and planar exterior surfaces that correspond in size and arrangement to the flat and planar interior surfaces defined by the axial bore 405 of the outer body 404. As described herein, the inner body 402 has a slightly smaller size than the axial bore 405 of the outer body 404, such that the inner body 402 is slidably received in the axial bore 405 of the outer body 404.

When the inner body 402 is received in the axial bore 405 of the outer body 404, the cylindrical portion 458 of the exterior of inner body 402 is received in the cylindrical interior portion 442 of the axial bore 405. Further, the rectangular portion 460 of the exterior of the inner body 402 is received in the rectangular portion 444 of the axial bore 405. The rectangular portion 460 of the inner body 402 and the rectangular portion 444 of the outer body 404 prevent the inner body 402 from rotating about a vertical axis through the clip 400. In other words, when the inner body 402 is manipulated and attempts to rotate, the flat and planar surfaces or sidewalls of the rectangular portion 444 of the outer body 404 contact the flat and planar and surfaces of the rectangular portion 460 of the inner body 402 to prevent such rotation. As such, the rectangular portions 444, 460 act as a stop or block to rotation of the inner body 402 relative to the outer body 404.

Unless the context requires otherwise, throughout the specification and claims which follow, the word "comprise" and variations thereof, such as, "comprises" and "comprising" are to be construed in an open, inclusive sense, that is as "including, but not limited to." Further, the terms "first," "second," and similar indicators of sequence are to be construed as interchangeable unless the context clearly dictates otherwise.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense that is as meaning "and/or" unless the content clearly dictates otherwise.

The relative terms "approximately" and "substantially," when used to describe a value, amount, quantity, or dimension, generally refer to a value, amount, quantity, or dimension that is within plus or minus 5% of the stated value, amount, quantity, or dimension, unless the content clearly dictates otherwise. It is to be further understood that any specific dimensions of components provided herein are for illustrative purposes only with reference to the exemplary embodiments described herein, and as such, the present disclosure includes amounts that are more or less than the dimensions stated, unless the context clearly dictates otherwise.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device, comprising:
a housing having opposing first and second surfaces, wherein the first surface is flat and planar, the housing including:
an axial bore extending at least partially through the housing to define sidewalls of the housing;
an opening extending through the second surface of the housing; and
a cavity extending through the housing between the first and second surfaces and integral with the opening;
a body slidably received in the axial bore of the housing and manipulatable between a first position and a second position, the body including:
a plate;
an opening in a sidewall of the body; and
a cavity extending through the body and integral with the opening of the body, wherein in the first position, the sidewall of the body blocks the opening of the housing and the cavity of the housing and wherein in the second position, the opening of the body and the cavity of the body are aligned with the opening of the housing and the cavity of the housing;
a decorative member having at least one flat and planar surface coupled to the first surface of the housing; and
a spring received in the axial bore of the housing and positioned between a base of the housing and the body.

2. The device of claim 1 wherein the housing includes at least one protrusion and the body includes at least one protrusion, the device further comprising:
a first pad coupled to the at least one protrusion of the housing; and
a second pad coupled to the at least one protrusion of the body.

3. The device of claim 1 wherein the body further includes an axial bore extending from a base of the body to a location proximate the cavity of the body and a protrusion extending into the axial bore of the body.

4. The device of claim 3 wherein the housing further includes a protrusion extending from the base of the housing into the axial bore of the housing.

5. The device of claim 4 wherein the protrusion of the body and the protrusion of the housing extend into an internal bore of the spring.

6. The device of claim 1 further comprising:
a pair of opposing protrusions extending from the body proximate the cavity of the body; and
a pair of opposing recesses in the housing proximate the cavity of the housing.

7. The device of claim 6 wherein in the first position, the pair of opposing protrusions of the body are proximate an outer boundary of the cavity of the housing and in the second position, each of the pair of opposing protrusions of the body are received in corresponding ones of the pair of recesses of the housing.

8. The device of claim 1 wherein the cavity of the housing has a maximum dimension that is greater than a maximum dimension of the opening of the housing.

9. A device, comprising:
an outer cylinder having a first surface and a second surface and sidewalls, the outer cylinder including:
a cavity extending through the sidewalls of the outer cylinder; and
an opening through the second surface of the outer cylinder connected to the cavity;
an inner cylinder structured to be slidably received in the outer cylinder and manipulatable between a first position and a second position, the inner cylinder including:
a cavity extending through the inner cylinder; and
an opening connected to the cavity, wherein in the first position, sidewalls of the inner cylinder are positioned in the cavity of the outer cylinder and wherein in the second position, the cavity and the opening of the inner cylinder align with the cavity and the opening of the outer cylinder;
at least one first protrusion extending from the outer cylinder or the inner cylinder; and
a first pad coupled to the at least one first protrusion.

10. The device of claim 9 further comprising:
a spring positioned between the inner and outer cylinders, the spring manipulatable between a relaxed configuration and a compressed configuration upon application of a compression force, the relaxed configuration corresponding to the first position and the compressed configuration corresponding to the second position.

11. The device of claim 9 further comprising:
a bore extending at least partially through the outer cylinder, the inner cylinder structured to be received in the bore.

12. The device of claim 9 wherein the at least one first protrusion extends from the outer cylinder.

13. The device of claim 12 wherein the inner cylinder further comprises:
at least one second protrusion extending from the inner cylinder; and
a second pad coupled to the at least one second protrusion.

14. The device of claim 13 wherein the outer cylinder includes a lip and the inner cylinder includes a third protrusion extending from the inner cylinder beyond the lip of the outer cylinder when the inner cylinder is in the first position.

15. A device comprising:
an outer body having a bore extending into the outer body and a cavity extending through the outer body, the outer body including at least one first protrusion;
an inner body structured to be received within the bore of the outer body, the inner body including a cavity extending through the inner body, the inner body including at least one second protrusion;
a first pad coupled to the at least one first protrusion of the outer body;
a second pad coupled to the at least one second protrusion of the inner body; and
a spring between the outer and inner bodies.

16. The device of claim 15 wherein the outer body includes a lip around the cavity and the inner body includes a third protrusion extending from the inner body into the bore beyond the lip of the outer body.

17. The device of claim 15 wherein the inner body has a cylindrical portion and a rectangular portion and the bore of the outer body defines an internal cylindrical portion and an internal rectangular portion, the cylindrical portion of the inner body structured to be received in the internal cylindrical portion of the outer body and the rectangular portion of the inner body is structured to be received in the internal rectangular portion of the outer body.

18. The device of claim 15 further comprising a decorative member coupled to the outer body.

19. The device of claim 15 wherein second pad has an outer edge and the inner body has a first surface with a flat portion and a curved portion, the outer edge of the second pad aligned with an interface between the flat portion and the curved portion of the first surface of the inner body.

* * * * *